US009371672B2

(12) United States Patent
Tseng et al.

(10) Patent No.: US 9,371,672 B2
(45) Date of Patent: Jun. 21, 2016

(54) SAFETY BRAKING DEVICE FOR DOORS

(75) Inventors: Wen Chang Tseng, Zhubei (TW); Jen Sen Chiang, Zhongli (TW)

(73) Assignee: Wen Chang Tseng (TW)

( * ) Notice: Subject to any disclaimer, the term of this patent is extended or adjusted under 35 U.S.C. 154(b) by 406 days.

(21) Appl. No.: 13/991,844

(22) PCT Filed: Dec. 6, 2011

(86) PCT No.: PCT/CN2011/002039

§ 371 (c)(1),
(2), (4) Date: Oct. 8, 2013

(87) PCT Pub. No.: WO2012/075681

PCT Pub. Date: Jun. 14, 2012

(65) Prior Publication Data

US 2014/0053370 A1 Feb. 27, 2014

(30) Foreign Application Priority Data

Dec. 8, 2010 (CN) ..... 2010 1 0577626

(51) Int. Cl.
*E05C 3/02* (2006.01)
*E05C 17/28* (2006.01)
(Continued)

(52) U.S. Cl.
CPC ..... *E05C 17/28* (2013.01); *E05C 17/00* (2013.01); *E05C 17/203* (2013.01); *E05C 17/24* (2013.01); *E05D 11/06* (2013.01); *Y10T 16/61* (2015.01)

(58) Field of Classification Search
CPC ..... E05C 17/00; E05C 17/24; E05C 17/28; E05F 5/00; E05F 5/02; E05D 11/06
USPC ..... 292/194, 195, 219, 220, DIG. 15, 292/DIG. 22, DIG. 65; 16/82; 296/146.11, 296/146.12
See application file for complete search history.

(56) References Cited

U.S. PATENT DOCUMENTS 2,942,833 A * 6/1960 Johnston, Jr. ..... F16D 41/00 16/82
3,100,122 A * 8/1963 Knapp ..... E05B 77/00 292/266

(Continued)

FOREIGN PATENT DOCUMENTS

CN 1397443 * 2/2003
CN 1397443 A 2/2003

(Continued)

OTHER PUBLICATIONS

China Examination Report for 201180045237.6 dated Aug. 1, 2014.

(Continued)

*Primary Examiner* — Carlos Lugo

(57) ABSTRACT

A safety braking device (1) for doors, which is arranged between a door board (21) and a permanent seat (22) of the door board, comprises a seat body (11) and a one-way locking mechanism. The seat body (11) is arranged in the door board (21). The one-way locking mechanism comprises a lock position element (12) and a connecting rod element (13). The lock position element (12) is arranged in the seat body (11) and can be switched between a locked position and an unlocked position. One end of the connecting rod element (13) is fixed onto the permanent seat (22) of the door board, and the other end thereof extends into the seat body (11) and corresponds to the lock position element (12). When at the locked position, the lock position element (12) as well as the seat body (11) cannot move in a first direction (91) with respect to the connecting rod element (13), and thereof the door board (21) cannot be opened and can only be closed; and only when the lock position element (12) is at the unlocked position can the door board (21) be opened or closed.

15 Claims, 28 Drawing Sheets

(51) Int. Cl.

| | |
|---|---|
| ***E05C 17/00*** | (2006.01) |
| ***E05C 17/24*** | (2006.01) |
| ***E05D 11/06*** | (2006.01) |
| ***E05C 17/20*** | (2006.01) |
| *E05C 3/00* | (2006.01) |

(56) References Cited

U.S. PATENT DOCUMENTS

| | | | | |
|---|---|---|---|---|
| 3,369,833 | A * | 2/1968 | Schaldenbrand | E05C 17/16 16/82 |
| 3,869,158 | A * | 3/1975 | Ciciulla | E05B 77/48 16/344 |
| 6,513,193 | B1 * | 2/2003 | Yezersky | E05C 17/203 16/86 A |
| 2006/0230574 | A1 * | 10/2006 | Murayama | E05C 17/203 16/58 |
| 2008/0271286 | A1 * | 11/2008 | Stalhammar | E05C 17/203 16/84 |

FOREIGN PATENT DOCUMENTS

| | | | |
|---|---|---|---|
| CN | 1486870 | A | 4/2004 |
| CN | 1847595 | A | 10/2006 |
| JP | 61-95873 | | 6/1986 |
| JP | 62-182382 | | 8/1987 |
| JP | 04166580 | A * | 6/1992 |
| JP | 2004-197379 | | 7/2004 |

OTHER PUBLICATIONS

Japan Examination Report for 2013-542335.
Taiwan Examination Report for 100143972 dated Nov. 26, 2015.

* cited by examiner

SAFETY BRAKING DEVICE FOR DOORS

This application claims the benefit of PCT Patent Application Serial No. PCT/CN2011/002039, filed on Dec. 6, 2011 (Publication No. WO 2012/075681 A1, Publication date on Jun. 14, 2012), the subject matter of which is incorporated herein by reference.

BACKGROUND OF INVENTION

1. Field of the Invention

The invention relates to a safety braking device for doors, and more particularly to the device mounted at vehicle's doors that can open and hold automatically the door board at specific angles so as to prevent the door board from an abnormal over-open state.

2. Description of the Prior Art

Currently, most of vehicles in the marketplace usually have stepless doors. While in meeting a strong wind or a slope road, the door may be suddenly over-opened to an unexpected large angle by the wind power or the gravity. Upon such a circumstance, risks of damaging the door, hurting or scaring the passengers, and hitting the pass-by pedestrians and/or bikes/motorbikes might be expected. Hence, in consideration of the aforesaid risks and safety concerns, a safety braking device for doors like the following in the present invention is highly motivated.

The present invention targets the opening of the vehicle doors to provide a solid solution for the aforesaid risks in vehicle operation. The key innovation of the safety braking device for doors in accordance with the present invention is to preset a safety open angle for the concerned door board. Also, within the safety open angle, two or more open states are included for providing operational mobility, meeting various passenger requests, and guaranteeing riding safety. Thereby, no matter where the person is in the vehicle or outsides, the vehicle door equipped with the safety braking device of the present invention can be opened to preset safety angles through a handler or a braking member. Thus, accidences caused by suddenly over-opening the vehicle door by unexpected foreign forcing can be avoided and therefore the vehicle riding safety can be substantially enhanced.

SUMMARY OF THE INVENTION

Accordingly, it is the primary object of the present invention to provide a safety braking device for doors that can avoid the door to be unexpected opened to a large angle while in meeting any foreign forcing such as a wind power or a gravity force.

It is another object of the present invention to provide the safety braking device for doors that furnishes a handler operated outside the door for opening the door board to a first angle by anchoring the door board to a permanent seat at a first angle position.

It is a further object of the present invention to provide the safety braking device for doors that, after using the handler of the safety braking device to open the door board to the first angle, the corresponding door board can be opened to achieve an additional second angle by operating continuously the handler and namely by anchoring the door board to the permanent seat at a second angle position.

It is a one more object of the present invention to provide the safety braking device for doors that, while in opening the door board from insides of the vehicle through the same safety braking device, a braking member is furnished to be depressed continuously so as to arbitrarily open the door board. Also, while the braking member is relieved, the door board can automatically anchor the door board to a third angle position at the permanent seat.

To achieve the aforesaid objects, the safety braking angle for doors of the present invention is arranged between the rotational door board and the permanent seat of the vehicle. The door board can perform open and close operations with respect to the permanent seat. The safety braking device for doors comprises:

a seat body, arranged in the door board; wherein, when the door board is shifting from a locked position to an unlocked position, the seat body moves along a first direction of the permanent seat; wherein, when the door board is shifting from the unlocked position to the locked position, the seat body moves along a second direction of the permanent seat;

a one-way locking mechanism, including a lock position element and a connecting rod element, the lock position element being able to displace toward and lock at the connecting rod element at a unique direction, the lock position element being arranged in and co-moved with the seat body, one end of the connecting rod element being fixed onto the permanent seat while another end thereof being extended into the seat body by corresponding to the lock position element, the lock position element being switched between an engaged position and a disengaged position; wherein, when the lock position element is at the engaged position, the lock position element as well as the seat body are fixed in the first direction with respect to the connecting rod element so as not to open the door board, but the lock position element associated with the seat body is displaceable in the second direction with respect to the connecting rod element so as to close the door board; wherein, when the lock position element is at the disengaged position, the door board is eligible to be opened and to be closed;

a spring element, engaged with the lock position element so as to restrain elastically the lock position element at the engaged position while in normal situations; and a positioning pair, including an elastic positioning member and a corresponding positioning block, wherein the elastic positioning member is arranged at the seat body while the corresponding positioning block is arranged at the lock position element;

wherein a first end portion of the connecting rod element is pivotally connected to the permanent seat, an external force is introduced to drive and switch the lock position element to the disengaged position so as simultaneously to open the door board by an angle less than a first angle $\theta 1$, and the corresponding positioning block is fixed to the elastic positioning member so as to sustain the lock position element at the disengaged position; wherein, when the door board is pushed away from the permanent seat to an angle larger than the first angle $\theta 1$, a position-resuming element connecting with the second end portion of the connecting rod element pushes and displaces the corresponding positioning block of the positioning pair away to separate the elastic positioning member, and the spring element resumes elastically the lock position element to the engaged position (namely, the door board is able to be locked to the permanent seat one-directionally after the door board is released from an angle larger than the first angle $\theta 1$).

In one embodiment of the present invention, the lock position element of the safety braking device for doors is a one-way ratchet-tooth cam including a pivotal portion and an extending ratchet-tooth portion, in which the pivotal portion is pivotally connected internally with the seat body by a pivotal shaft. In this embodiment, the connecting rod element is a one-way ratchet-tooth rack including a teeth portion, the first end portion and the second end portion, in which the teeth portion is meshed with the ratchet-tooth portion of the one-way ratchet-tooth cam. Also, the spring element is furnished to ensure a normal meshing state between the one-directional ratchet-tooth cam and the one-directional ratchet-tooth rack and thus able to activate functions of the one-way locking mechanism upon the lock position element being driven to disengage with the one-way ratchet-tooth rack.

In one embodiment of the present invention, the safety braking device for doors further includes a first cable and a handler, in which the handler connects a fixed end of the first cable while an opposing connection end of the first cable is connected with the one-way ratchet-tooth cam so as to pull the one-way ratchet-tooth cam to rotate about the pivotal shaft. In this embodiment, when an additional angle (specifically, a second angle $\theta 2$) over the first angle $\theta 1$ is required for the door board, the handler needs to be operated continuously so as to have the first cable to pull the one-way ratchet-tooth cam to disengage the one-way ratchet-tooth rack. At this time, a total open angle $\theta T$ for the door board is defined as $\theta T = \theta 1 + \theta 2$, in which the first angle $\theta 1$ is ranged from 20° to 50° and the total open angle $\theta T$ is ranged from 20° to 90°.

In one embodiment of the present invention, the safety braking device for doors further included a second cable and a braking member. The braking member is arranged inside the door board and connected with (and thus driven by) a fixed end of the second cable, while an opposing connection end of the second cable is connected to the one-way ratchet-tooth cam so as to pull and thus turn the one-way ratchet-tooth cam around the pivotal shaft. In this embodiment, when the door board needs to be opened from the permanent seat, the braking member needs to be operated continuously so as to have the second cable to pull the one-way ratchet-tooth cam to disengage the one-way ratchet-tooth rack. Upon the braking member is released, the spring element sends the one-way ratchet-tooth cam elastically back to engage the one-way ratchet-tooth rack so as to have the lock position element to elastically resume the engaged position.

In one embodiment of the present invention, the one-way locking mechanism of the safety braking device for doors further includes a hollow cylinder fixed at the seat body, in which the cylinder has thereof an air orifice at a position corresponding to the lock position element. In this embodiment, the lock position element further includes a pivotal portion and an orifice plug, in which the pivotal portion is pivotally mounted inside the seat body via another pivotal shaft and the orifice plug is located at a position corresponding to the air orifice. In this embodiment, the engaged position of the lock position element is a tight position between the air orifice and the orifice plug, and the disengaged position thereof is a loose position between the air orifice and the orifice plug. Also, the connecting rod element is formed as a piston rod further having a piston end close to the orifice plug. Under normal situations, the spring element keeps the orifice plug of the lock position element to engage tightly with the air orifice of the cylinder. On the other hand, under predetermined forcing upon the lock position element, the orifice plug is disengaged from the air orifice so as to perform functions of the one-way locking mechanism.

In one embodiment of the present invention, the connecting rod element of the safety braking device for doors is a gear rack and the lock position element further includes discretely a pivotal portion and a ratchet-tooth portion. The ratchet-tooth portion formed as a vertical longitudinal block is pivotal mounted in a middle position to the seat body so as to swing thereabout both clockwise and counterclockwise and the ratchet-tooth portion further has an upper half portion thereof to contact, from a left-hand side, against a position-resuming element while the pivotal portion contacts against the ratchet-tooth portion from a right-hand side of the ratchet-tooth portion (i.e., opposite to the position-resuming element). Upon such an arrangement, the ratchet-tooth portion can be free from any foreign forcing (i.e., the normal situations) and posed at a vertical upright position to engage the gear rack located under the ratchet-tooth cam.

In this embodiment, when the lock position element is at the normal situations (i.e., free from any foreign forcing), the lock position element is kept at the engaged position where the right-hand side of the upper half portion of the ratchet-tooth portion is locked by geometrical interference with the pivotal portion so as to lock as well the door board. On the other hand, when the door board is to be closed, a lower portion of the ratchet-tooth portion is pushed by the gear rack and thereby to co-move the upper half portion of the ratchet-tooth portion to depress and thus shrink the position-resuming element so as to have the lower portion of the ratchet-tooth portion to disengage the gear rack, and thereupon the door board is freely to be closed by performing the aforesaid functions of the one-way locking mechanism.

Also, in this embodiment, when the lock position element is switched to the disengaged position by foreign forcing, one end of the pivotal portion is lifted to leave the upper half portion of the ratchet-tooth portion so as to temporarily relieve the functions of the one-way locking mechanism and to make the door board ready to be opened or closed.

In one embodiment of the present invention, the safety braking device for doors further includes an idle gear located between, and also meshed in between with, the lower portion of the ratchet-tooth portion and the gear rack.

In one embodiment of the present invention, the safety braking device for doors further includes at least one of a electromagnetic braking mechanism, a neutral mechanism, a relief mechanism and an emergency relief design.

In this embodiment, the electromagnetic mechanism can further have at least one electromagnetic valve and at least one button switch. The button switch is to be depressed to activate the corresponding electromagnetic valve so as to have the lock position element to switch between the engaged position and the disengaged position.

In this embodiment, the neutral mechanism is to provide the one-way locking mechanism a grace distance during an initial stage of opening the door board, in which the one-way locking mechanism does not function within the grace distance.

In this embodiment, the relief mechanism is to relieve one-way locking function of the one-way locking mechanism so as to have the door board to rotate freely to any angle without facing any position-locking situation.

In this embodiment, the emergency relief design is to enable the door board to be opened to a substantial large angle by emergency forcing while in meeting an emergency situation.

In another aspect of the present invention, the safety braking device for doors is arranged between a door board and a permanent seat, in which the door board has an unlocked (opened) position and a locked (closed) position with respect the permanent seat. The safety braking device for doors of this aspect of the invention comprises:

a seat body, arranged and fixed in the door board; wherein, when the door board is shifting from the locked position to the unlocked position with respect to the permanent seat, the seat body moves along a first direction of the permanent seat; wherein, when the door board is shifting from the unlocked position to the locked position, the seat body moves along a second direction of the permanent seat a one-way locking mechanism, including a lock position element and a connecting rod element, the lock position element being able to displace toward and lock at the connecting rod element at a unique direction, the lock position element being arranged in and co-moved with the seat body, one end of the connecting rod element being fixed onto the permanent seat while another end thereof being extended into the seat body by corresponding to the lock position element; and at least one cable mechanism, one end of the cable mechanism being connected with the position lock element while another end thereof is connected with a braking member, the braking member being operated to drive the cable mechanism to make the lock position element switchable between an engaged position and a disengaged position.

wherein, when the lock position element is at the engaged position, the lock position element as well as the seat body are fixed in the first direction with respect to the connecting rod element so as not to open the door board; wherein, when the lock position element is at the disengaged position, the door board is to be opened In one embodiment of the present invention, the lock position element of the safety braking device for doors is a one-way ratchet-tooth cam further including a pivotal portion and an extending ratchet-tooth portion, in which the pivotal portion is pivotally connected internally with the seat body by a pivotal shaft. Also, the connecting rod element is a one-way ratchet-tooth rack, one end thereof being fixed to the permanent seat while another end thereof is extended into the seat body so as to have the one-way ratchet-tooth cam able to engage and disengage the one-way ratchet-tooth rack. The one-way ratchet-tooth rack further includes a teeth portion, a first end portion and a second end portion. The cable mechanism includes a first cable and a second cable. In this embodiment, the safety braking device for doors further includes a spring element, a positioning pair and a handler. The spring element can restrain elastically the one-way ratchet-tooth cam at an engaged state with the one-way ratchet-tooth rack while under a situation of being free of foreign forcing. The positioning pair consists of an elastic positioning member and a corresponding positioning block, in which the elastic positioning member is arranged at the seat body while the corresponding positioning block is arranged at the one-way ratchet-tooth cam. The handler is arranged at an external side of the door board.

In this embodiment, the handler is connected with a fixed end of the first cable while an opposing connection end of the first cable is connected with the one-way ratchet-tooth cam. Thereby, the handler can be turned to displace the one-way ratchet-tooth cam and so as to disengage the one-way ratchet-tooth cam from the one-way ratchet-tooth rack. The braking member is arranged inside the door board and connected with (and thus driven by) a fixed end of the second cable while an opposing connection end of the second cable is connected to the one-way ratchet-tooth cam so as to pull and thus turn the one-way ratchet-tooth cam around the pivotal shaft; such that the braking member can then be operated to drive the one-way ratchet-tooth cam to disengage the teeth portion.

In this embodiment, the first end portion of the one-way ratchet-tooth rack is pivotally connected to the permanent seat, the handler is to pull the first cable to disengage the one-way ratchet-tooth cam from the one-way ratchet-tooth rack so as simultaneously to open the door board by an angle less than a first angle θ1, and the corresponding positioning block is fixed to the elastic positioning member so as to sustain the lock position element at the disengaged position. When the door board is pushed away from the permanent seat to an angle larger than the first angle θ1, a position-resuming element connecting with the second end portion of the one-way ratchet-tooth rack can then push and displace the corresponding positioning block of the positioning pair away to separate the elastic positioning member, and the spring element resumes elastically the lock position element to the engaged position (namely, the door board is able to be locked to the permanent seat one-directionally after the door board is released from an angle larger than the first angle θ1).

In this embodiment, the braking member can be operated continuously so as to have the one-way ratchet-tooth cam to disengage the one-way ratchet-tooth rack and thus to keep the door board being opening with respect to the permanent seat. Upon the braking member is released, the spring element sends the one-way ratchet-tooth cam elastically back to engage the one-way ratchet-tooth rack so as to have the lock position element to elastically resume the engaged position In one embodiment of the present invention, when an additional angle (specifically, a second angle θ2) over the first angle θ1 is required for the door board, the handler needs to be operated continuously so as to have the first cable to pull the one-way ratchet-tooth cam to disengage the one-way ratchet-tooth rack, in which a total open angle θT for the door board is defined as $\theta T=\theta 1+\theta 2$, and in which the first angle θ1 is ranged from 20° to 50° and the total open angle θT is ranged from 20° to 90°.

In one embodiment of the present invention, the one-way locking mechanism of the safety braking device for doors further includes a hollow cylinder fixed at the seat body, the cylinder further having thereof an air orifice at a position corresponding to the lock position element.

In this embodiment, the lock position element can further include a pivotal portion and an orifice plug, in which the pivotal portion is pivotally mounted inside the seat body via another pivotal shaft and the orifice plug is located at a position corresponding to the air orifice.

In this embodiment, the connecting rod element is a piston rod further having a piston end close to the orifice plug.

In this embodiment, the lock position element is driven by the cable mechanism so as to be switched between the engaged position and the disengaged position. Under normal situations, the orifice plug engages tightly upon the air orifice of the cylinder so as to keep the lock position element at the engaged position. When the lock position element is driven by the cable mechanism, the orifice plug is disengaged from the air orifice (from the engaged position to the disengaged position) so as to perform functions of the one-way locking mechanism.

In one embodiment of the present invention, the connecting rod element of the safety braking device for doors is formed as a gear rack and the lock position element can further include discretely a pivotal portion and a ratchet-tooth portion. The ratchet-tooth portion formed as a vertical longitudinal block is pivotal mounted in a middle position to the seat body so as to swing thereabout both clockwise and counter-clockwise, and the ratchet-tooth portion also has an upper half portion thereof to contact from a left-hand side against a position-resuming element while the pivotal portion contacts against the ratchet-tooth portion from a right-hand side of the ratchet-tooth portion (i.e., opposite to the position-resuming element). Upon such an arrangement, when the ratchet-tooth portion is free from any foreign forcing (i.e., the normal situations), the ratchet-tooth portion is posed at a vertical upright position to engage the gear rack located thereunder.

In this embodiment, when the lock position element is at the normal situations (i.e., free from any foreign forcing), the lock position element is kept at the engaged position where the right-hand side of the upper half portion of the ratchet-tooth portion is locked by geometrical interference with the pivotal portion so as to lock as well the door board. When the door board is to be closed, a lower portion of the ratchet-tooth portion is pushed by the gear rack and thereby to co-move the upper half portion of the ratchet-tooth portion to depress and thus shrink the position-resuming element so as to have the lower portion of the ratchet-tooth portion to disengage the gear rack, and thereupon the door board is free to be closed by performing the aforesaid functions of the one-way locking mechanism.

In this embodiment, when the lock position element is switched to the disengaged position by foreign forcing, one end of the pivotal portion is lifted to leave the upper half portion of the ratchet-tooth portion so as to temporarily relieve the functions of the one-way locking mechanism and to make the door board ready to be opened or closed.

In one embodiment of the present invention, the safety braking device for doors can further includes an idle gear located between, and also meshed in between with, the lower portion of the ratchet-tooth portion and the gear rack.

In one embodiment of the present invention, the safety braking device for doors further includes at least one of a electromagnetic braking mechanism, a neutral mechanism, a relief mechanism and an emergency relief design.

In this embodiment, the electromagnetic mechanism can further have at least one electromagnetic valve and at least one button switch. The button switch is to be depressed to activate the corresponding electromagnetic valve so as to have the lock position element to switch between the engaged position and the disengaged position.

In this embodiment, the neutral mechanism is to provide the one-way locking mechanism a grace distance during an initial stage of opening the door board, in which the one-way locking mechanism does not function within the grace distance.

In this embodiment, the relief mechanism is to relieve one-way locking function of the one-way locking mechanism so as to have the door board to rotate freely to any angle without facing any position-locking situation.

In this embodiment, the emergency relief design is to enable the door board to be opened to a substantial large angle by emergency forcing while in meeting an emergency situation.

In summary, the safety braking device for doors in accordance with the present invention is mainly to be equipped to a vehicle door, at a location between a door board and a permanent seat inside the vehicle. The safety braking device can include a seat body, a one-way ratchet-tooth cam, a one-way ratchet-tooth rack, a spring element, a position-resuming element and a positioning pair. The seat body is arranged at the door board. The one-way ratchet-tooth cam further includes a pivotal portion and a ratchet-tooth portion, in which a pivotal shaft is introduced to mount the one-way ratchet-tooth cam onto the seat body through the pivotal portion. The one-way ratchet-tooth rack is meshed with the ratchet-tooth portion of the one-way ratchet-tooth cam. The one-way ratchet-tooth rack further includes a first end portion and an opposing second end portion. The spring element is to keep the one-way ratchet-tooth cam to mesh the one-way ratchet-tooth rack under normal situations (free of external forcing). The positioning pair includes an elastic positioning member and a corresponding positioning block, in which the elastic positioning member is arranged at the seat body while the corresponding positioning block is arranged at the one-way ratchet-tooth cam.

The first end portion of the one-way ratchet-tooth rack is pivotally mounted to the permanent seat. A fixation end of a first cable is connected to a handler located exteriorly at the door board, while another connection end of the first cable is connected to the one-way ratchet-tooth cam so as to pull and displace the one-way ratchet-tooth cam. Upon such an arrangement, appropriate operation on the handler can pull the one-way ratchet-tooth cam to disengage the one-way ratchet-tooth rack so as to unlock the door board. As an anchor point at the corresponding positioning block is elastically crossed with and stopped at the elastic positioning member, the door board is opened by a first angle with respect to the permanent seat. By having the position-resuming element connected with the second end portion of the one-way ratchet-tooth rack to displace the corresponding positioning block of the positioning pair, the anchor point can leave the elastic positioning member, and thus the spring element sends elastically back the one-way ratchet-tooth cam to engage the one-way ratchet-tooth rack; such that the door board is again locked but opened at the first angle.

Further, if a large open angle greater the first angle is desired to the door board, the handler is needed to continuously pull the first cable so as to disengage the one-way ratchet-tooth cam and the one-way ratchet-tooth rack, and thereby the door board can be further opened by an additional second angle from the first angle. At this time, the one-way ratchet-tooth cam cannot be affected by the positioning pair until the operation on the handler is relieved, and then the spring element would release a preset resilience to resume the engagement between the one-way ratchet-tooth cam and the one-way ratchet-tooth rack.

A braking member is located interiorly at the door board. A fixation end of a second cable is connected to the braking member, while another connection end of the second cable is connected with the one-way ratchet-tooth cam so as to pull and displace the one-way ratchet-tooth cam. Through continuously activating the braking member to disengage the one-way ratchet-tooth cam from the one-way ratchet-tooth rack, then the door board can successfully opened with respect to the permanent seat. In addition, when the pulling upon the braking member is released, the spring element would react to resume the engagement between the one-way ratchet-tooth cam and the one-way ratchet-tooth rack; such that the door board can be further but arbitrarily opened to a third angle.

All these objects are achieved by the safety braking device for doors described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a safety braking device for doors. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
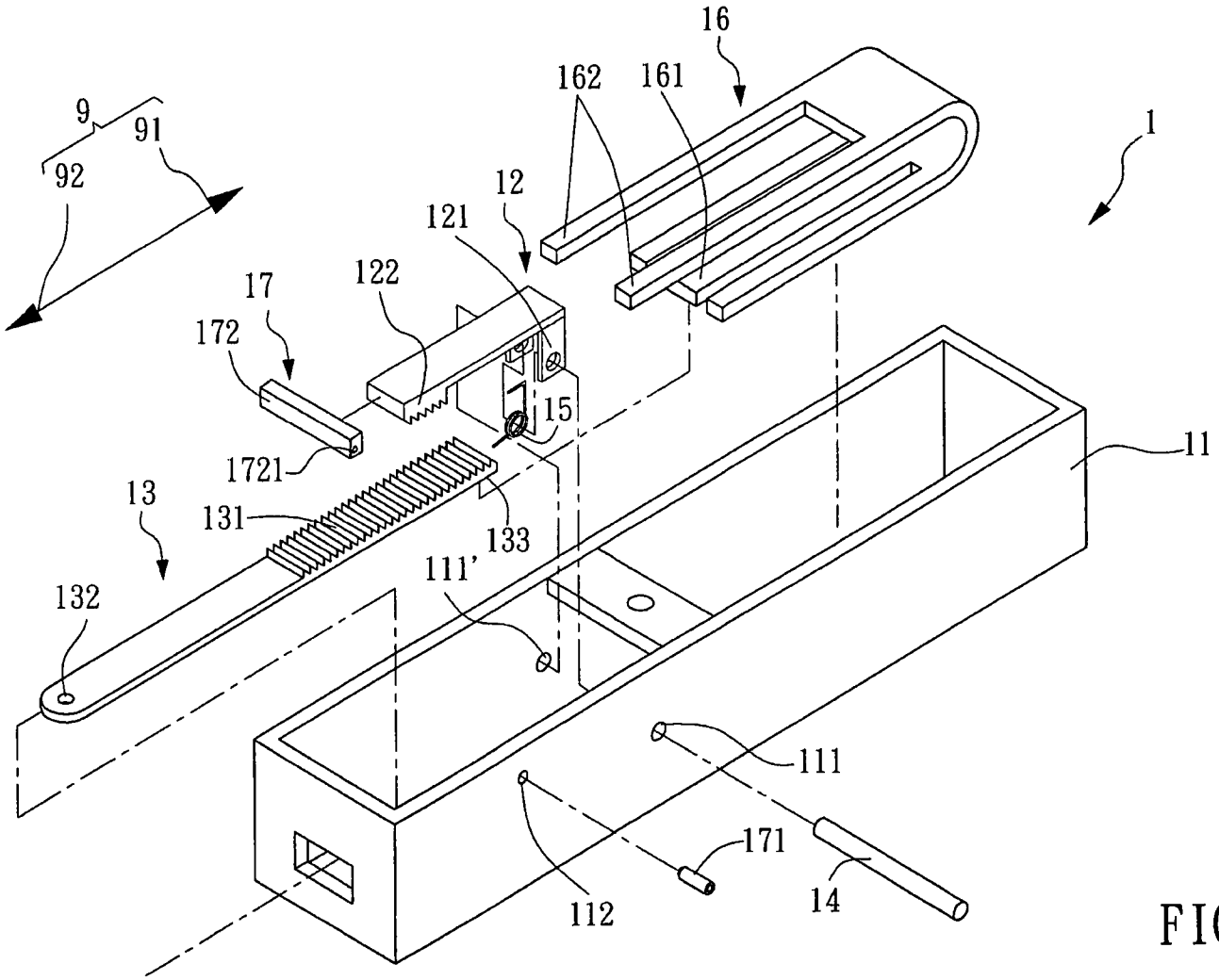
FIG. 1 is an exploded view of a first embodiment of the safety braking device for doors in accordance with the present invention.
Figure 2:
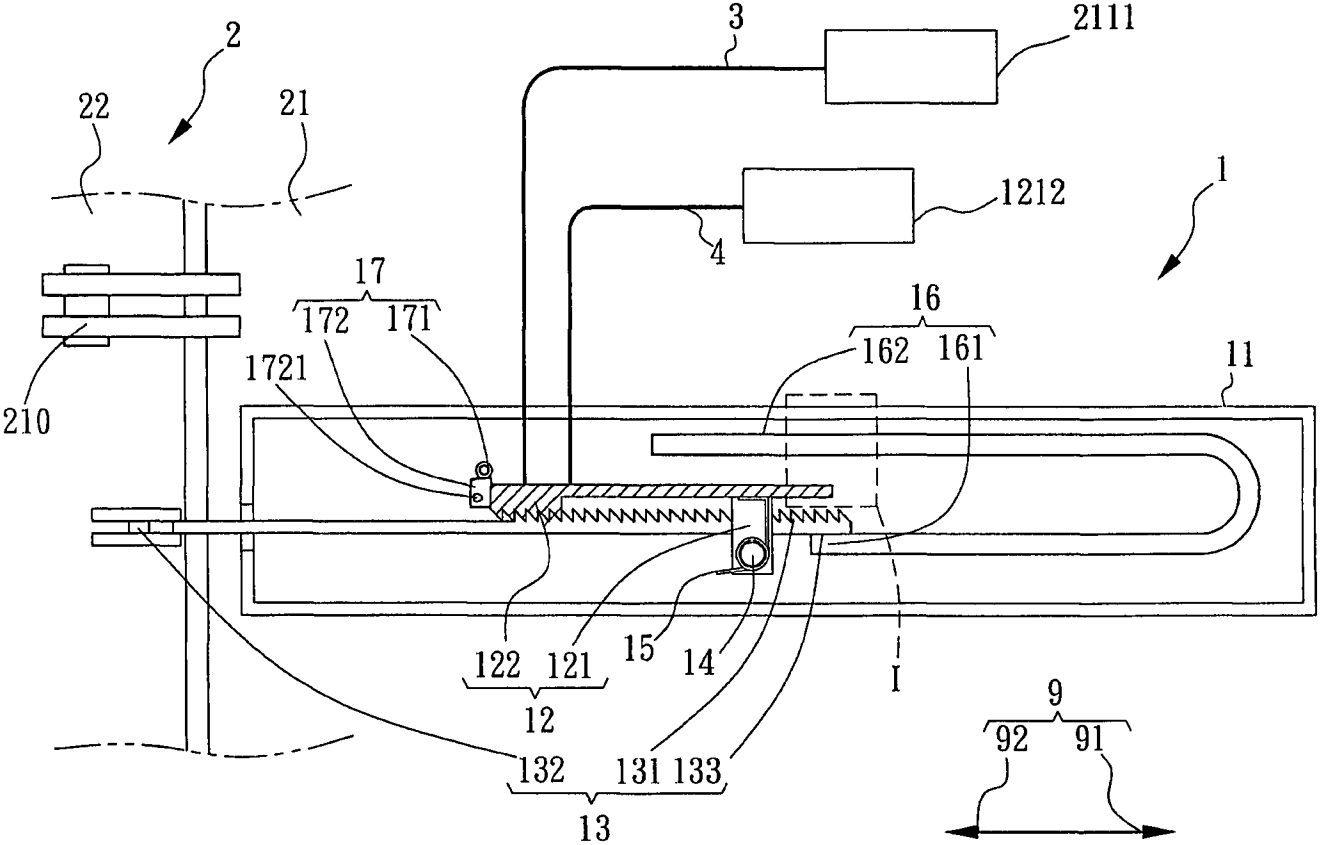
FIG. 2 is a schematic side view of the safety braking device of FIG. 1 and a portion of vehicle structure for constructing the safety braking device.
Figure 3:
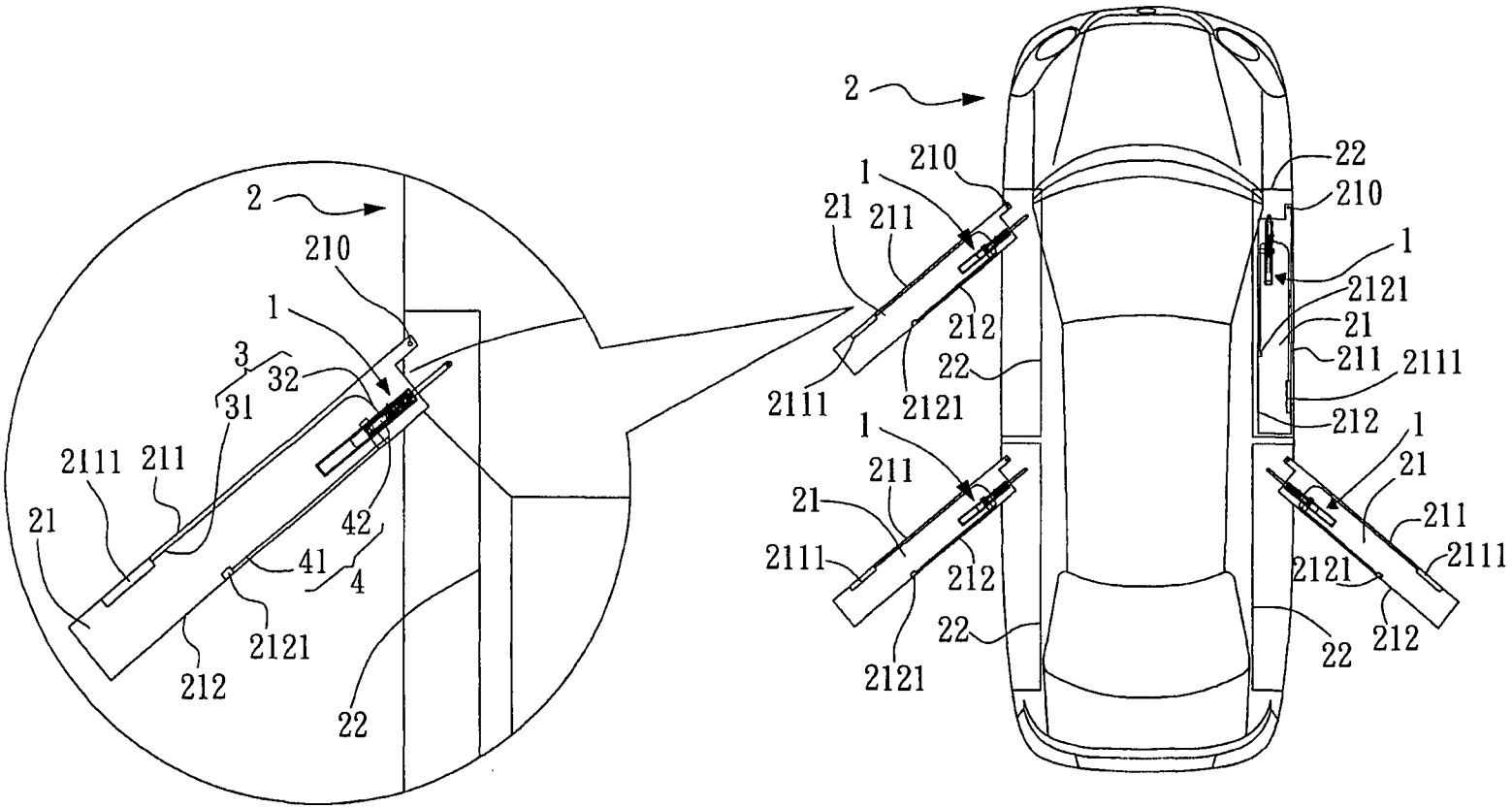
FIG. 3 is a schematic top view of a vehicle having doors equipped with the safety braking device of FIG. 1.

Referring now to FIG. 1, FIG. 2 and FIG. 3, a first embodiment of the safety braking device for doors in accordance with the present invention is shown in an exploded view, a side view and a top view, respectively. The safety braking device 1 of the present invention is preferably installed on a vehicle body 2, and is operated between a door board 21 and a permanent seat 22 of the vehicle body 2, in which the door board 21 can perform an opening operation and a closing operation with respect to the permanent seat 22.

In the present invention, the safety braking device for doors 1 mainly includes a seat body 11 and a one-way locking mechanism. The one-way locking mechanism further includes a lock position element and a connecting rod element. The lock position element can lock the displacement of the connecting rod element at a unique direction. The lock position element is mounted inside and co-moved with the seat body. One end of the connecting rod element is fixed to the permanent seat, while another end thereof is extended into the seat body at a position corresponding to the lock position element. The lock position element can be switched between an engaged position and a disengaged position. In the case that the lock position element is at the engaged position, the lock position element integrates the seat body as a unique assembly that is unable to displace with respect to the connecting rod element along a first direction, such that the door board can be closed only, but not able to be opened. On the other hand, in the case that the lock position element is at the disengaged position, the door board can be either opened or closed.

As shown in FIG. 1 to FIG. 3, the lock position element is embodied as a one-way ratchet-tooth cam 12 (formed as an extended arm), and the connecting rod element is embodied as a one-way ratchet-tooth rack 13. The safety braking device 1 further includes a pivotal shaft 14, a spring element 15, a position-resuming element 16 and a positioning pair 17. In the vehicle body 2, the door board 21 is pivotal about a rotational pivot shaft 210 at the permanent seat 22 so as to form an angular open/close manner between the door board 21 and the permanent seat 22. For a concise purpose, a quasi-linear direction system 9 is assigned to the safety braking device 1 that is mainly carried by and thus moved synchronically with the door board 21. The quasi-linear system 9 includes a first direction 91 and an opposing second direction 92. The first direction 91 is to symbolize the open-door direction of the door board 21 with respect to the permanent seat 22 (the vehicle body 2 as well), while the second direction 92 is to symbolize the close-door direction of the door board 21 with respect to the permanent seat 22.

The one-way ratchet-tooth cam 12, able to mesh the one-way ratchet-tooth rack 13, can further includes a pivotal portion 121 and a ratchet-tooth portion 122. As shown in FIG. 1, the one-way ratchet-tooth cam 12 is mounted at a predetermined location inside the seat body 11, in which the pivotal shaft 14 is used to perform the aforesaid mounting by penetrating in order a shaft hole 111 at one lateral side of the seat body 11, the pivotal portion 121 of the one-way ratchet-tooth cam 12, and another shaft hole 111' at another lateral side of the seat body 11. Thereupon, the one-way ratchet-tooth cam 12 and the seat body 11 of the door board 21 can be synchronically displaced in the quasi-linear direction system 9.

One end of the one-way ratchet-tooth rack 13 is fixed to the permanent seat 22, while another end thereof is extended into the seat body 11 to a position corresponding to the one-way ratchet-tooth cam 12, such that the one-way ratchet-tooth rack 13 and the one-way ratchet-tooth cam 12 can form an engage/disengage-able pair inside the seat body 11. The one-way ratchet-tooth rack 13 can further include a teeth portion 131, a first end portion 132 and a second end portion 133. The teeth portion 131 is to mesh the ratchet-tooth portion 122 of the one-way ratchet-tooth cam 12. The first end portion 132 is pivotally connected to the permanent seat 22. The second end portion 133 is connected with the position-resuming element 16. In the case that the teeth portion 131 engages with the ratchet-tooth portion 122, the door board 22 is opt to close onto the permanent seat 2. Thereby, the one-way ratchet-tooth cam 12 can perform a displacement of the second direction 92 inside the seat body 11, but not the movement of the first direction 91; such that the opened vehicle door can be prevented from being suddenly opened with the help of the fixation relationship between the door board 21 and the permanent seat 21.

The positioning pair 17 is to control the engagement/disengagement between the one-way ratchet-tooth cam 12 and the one-way ratchet-tooth rack 13; i.e., to determine whether or not the opened door board 21 can be fixed at a predetermined angle with respect to the permanent seat 22. The positioning pair 17 further includes an elastic positioning member 171 and a corresponding positioning block 172. The elastic positioning member 171 is arranged at a position point 112 preset on the seat body 11. The corresponding positioning block 172 is arranged at an end of the ratchet-tooth portion 122 of the one-way ratchet-tooth cam 12. As shown in FIG. 2, the corresponding positioning block 172 further has an anchoring cavity 1721 for the elastic positioning member 171 to perform an elastic anchoring in between with the corresponding positioning block 172. In another embodiment, the corresponding positioning block 172 can be integrated to the one-way ratchet-tooth cam 12 as a unique piece. Yet, such a formation is well known in the art, and thus details thereabout are omitted herein.

The position-resuming element 16 is formed as a bent U-shape part, having one connection end 161 to connect to the second end portion 133 of the one-way ratchet-tooth rack 13 at a position opposing to the teeth formation of the teeth portion 131, while another action end 162 thereof is to push and thus displace the corresponding positioning block 172 so as to disengage the elastic positioning member 171 away from the anchoring cavity 1721. Namely, the position-resuming element 16 is co-moved with and thus controlled by the one-way ratchet-tooth rack 13 to further determine the engagement/disengagement between the elastic positioning member 171 and the corresponding positioning block 172. As shown in FIG. 1, the action end 162 of the position-resuming element 16 is preferred to be formed as a fork shape with two separate arms so as to have a slot space between two arms able not to cause any geometrical interference with the one-way ratchet-tooth cam 12 while the position-resuming element 16 is fed to push the corresponding positioning block 172 to disengage the elastic positioning member 171 and so as to further separate the corresponding positioning block 172 from the one-way ratchet-tooth cam 12. Upon such an arrangement, the disengaged position of the one-way ratchet-tooth cam 12 can be obtained. Similarly, the position-resuming element 16 can be integrated with the one-way ratchet-tooth rack 13 as a unique piece.

The spring element 15 is mainly to maintain the engagement between the one-way ratchet-tooth cam 12 and the one-way ratchet-tooth rack 13, while the one-way ratchet-tooth cam 12 is free of foreign actions. Preferably, the spring element 15 can be a resilient spring, in particular a torsion spring. As shown in FIG. 1 and FIG. 2, the spring element 15 is to sleeve the pivotal shaft 14 in the pivotal portion 121 of the one-way ratchet-tooth cam 12, with one end thereof to connect with the one-way ratchet-tooth cam and another end thereof to connect with the seat body 11. In the case that the door board 21 and the permanent seat 22 are at the normal close state, the ratchet-tooth portion 122 of the one-way ratchet-tooth cam 12 is meshed with the teeth portion 131 of the one-way ratchet-tooth rack 13. Only when the ratchet-tooth portion 122 is pulled to disengage the teeth portion 131, the door board 21 can then be rotational turned to become opened with respect to the permanent seat 22.

As shown in FIG. 2 and FIG. 3, a handler 2111 is installed to an exterior side 211 of the door board 21, and a braking member 2121 is installed to an interior side 212 of the door board 21. The handler 2111 and the braking member 2121 are both connected with the one-way ratchet-tooth cam 12 via individual cable mechanisms. In this embodiment, the cable mechanism can be embodied as two cables 3, 4 as shown, connecting rods, cams or any force transmission element/mechanism the like. The handler 211 is connected with a fixation end 31 of the first cable 3, while another connection end 32 thereof is connected to the one-way ratchet-tooth cam 12. The braking member 2121 is connected with a fixation end 41 of the second cable 4, while the connection end 42 thereof is connected also to the one-way ratchet-tooth cam 12. In the present invention, the handler 2111 can be the outside door-pulling handle of ordinary vehicle but implemented by connecting the aforesaid first cable 3. Also, the braking member 2121 can be the interior door-open handle or button of ordinary vehicle located close to the interior armrest of the door, by which the driver or passengers can easily operate the braking member 2121 while in meeting a need of opening door.

In another embodiment of the present invention, the safety braking device for doors 1 can be equipped with an additional electromagnetic driving mechanism (not shown herein). In this embodiment, the fixation end 31 of the first cable 3 can connect both the handler 2111 and a first electromagnetic valve (not shown herein), in which the first electromagnetic valve has a first button located at or close to the handler 2111 on the exterior side 211 of the door board 21. As long as the first button is depressed, the first electromagnetic valve would be activated to pull the first cable 3 so as to mimic user's hand pull upon the handler 2111. In addition, the fixation end 41 of the second cable 4 can connect both the hand-operated braking member 2121 and a second electromagnetic valve (not shown herein), in which the second electromagnetic valve has a second button located at or close to the handle on the interior side of the door board 21. As long as the second button is depressed, the second electromagnetic valve would be activated to pull the second cable 4 so as to mimic user's hand pull upon the braking member 2121. Accordingly, the safety braking device for doors 1 of the present invention can be easily versatile embodied as a pure electromagnetic driving device, a hand-operated device, or the device with the aforesaid two operation modes. Thus, the advantage of the present invention in excellent usage convenience is obvious.

Figure 4A:
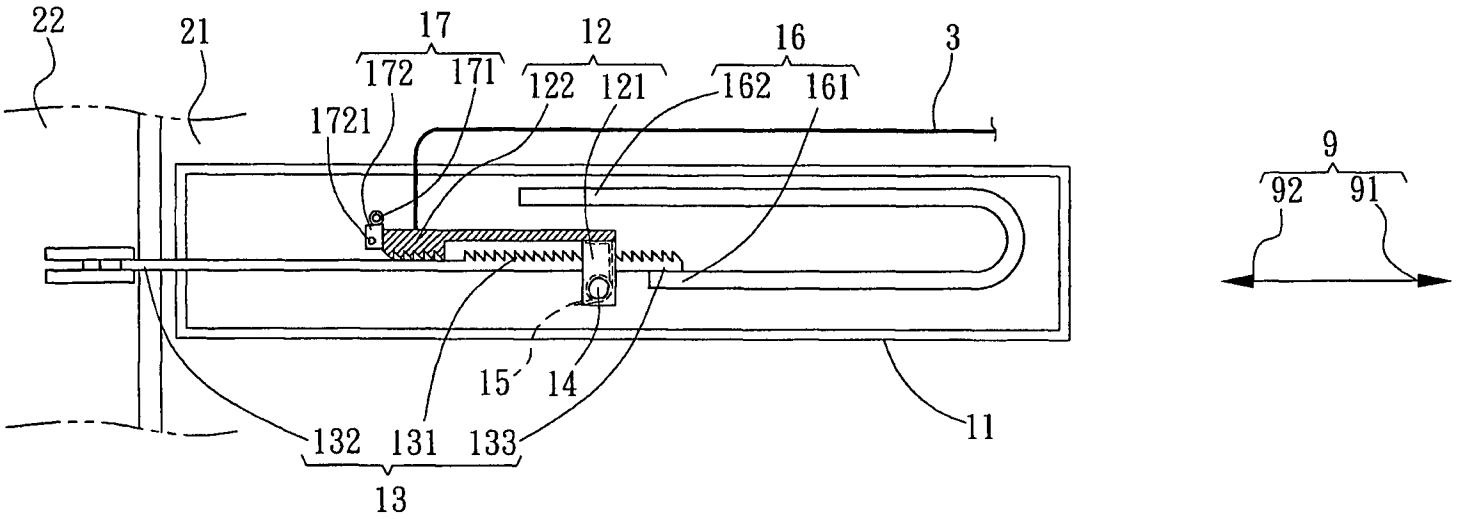
FIG. 4A~FIG. 4E illustrate continuously and schematically the opening of the door board by the handler exteriorly mounted at the door board of the safety braking device in accordance with the present invention.
Figure 4B:
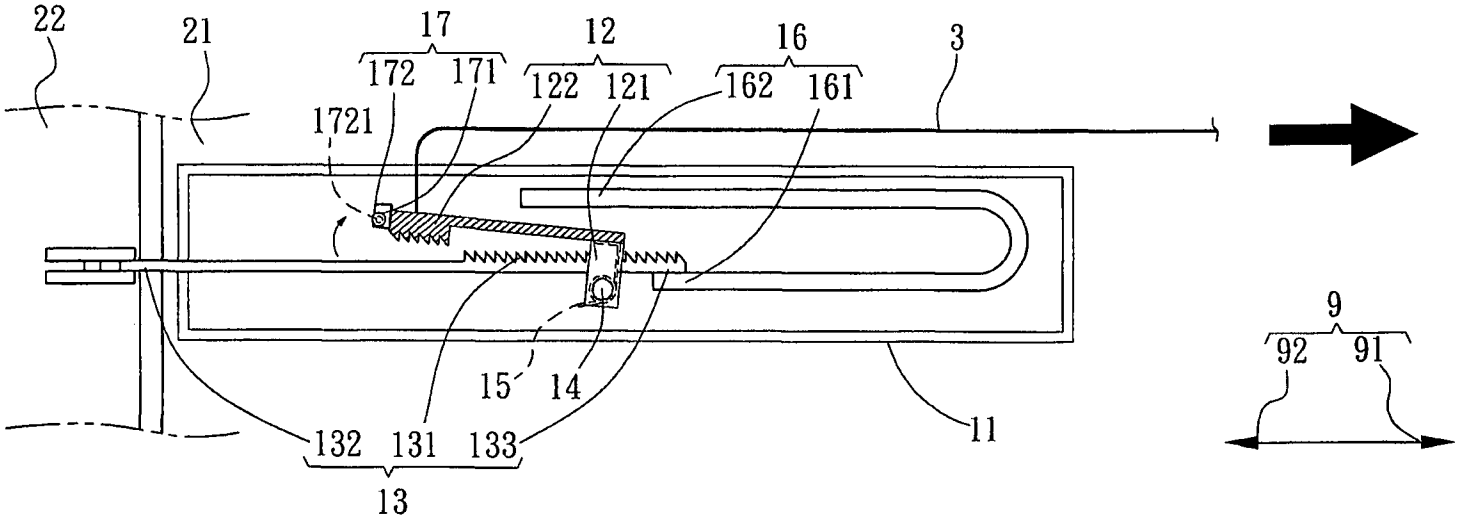
Figure 4C:
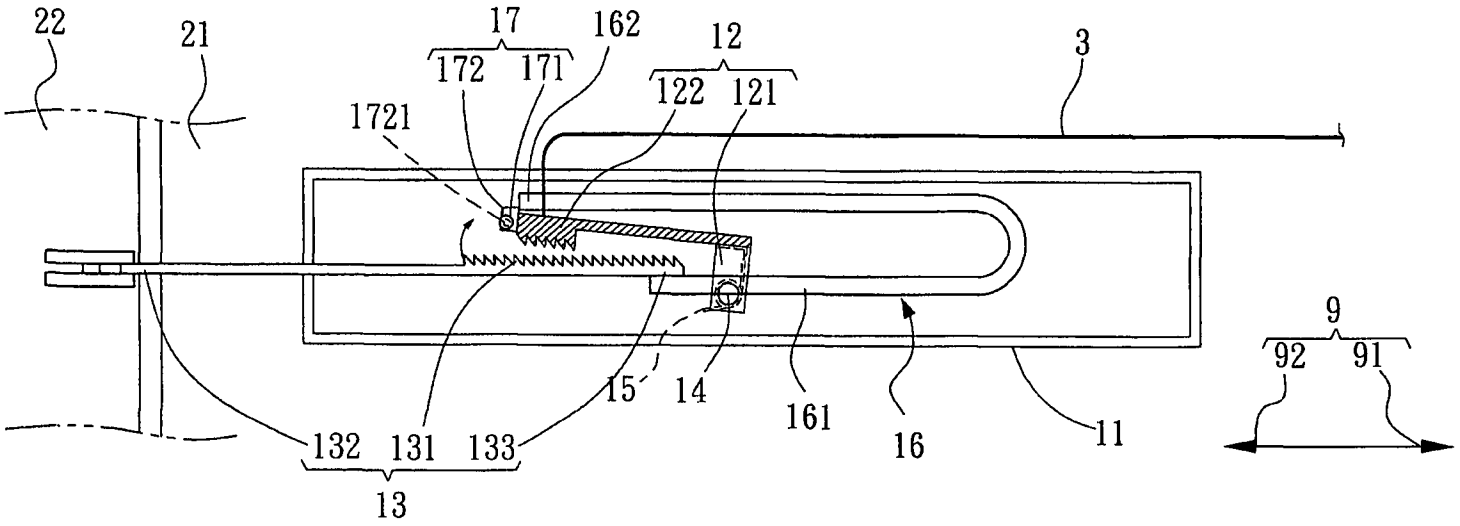
Figure 4D:
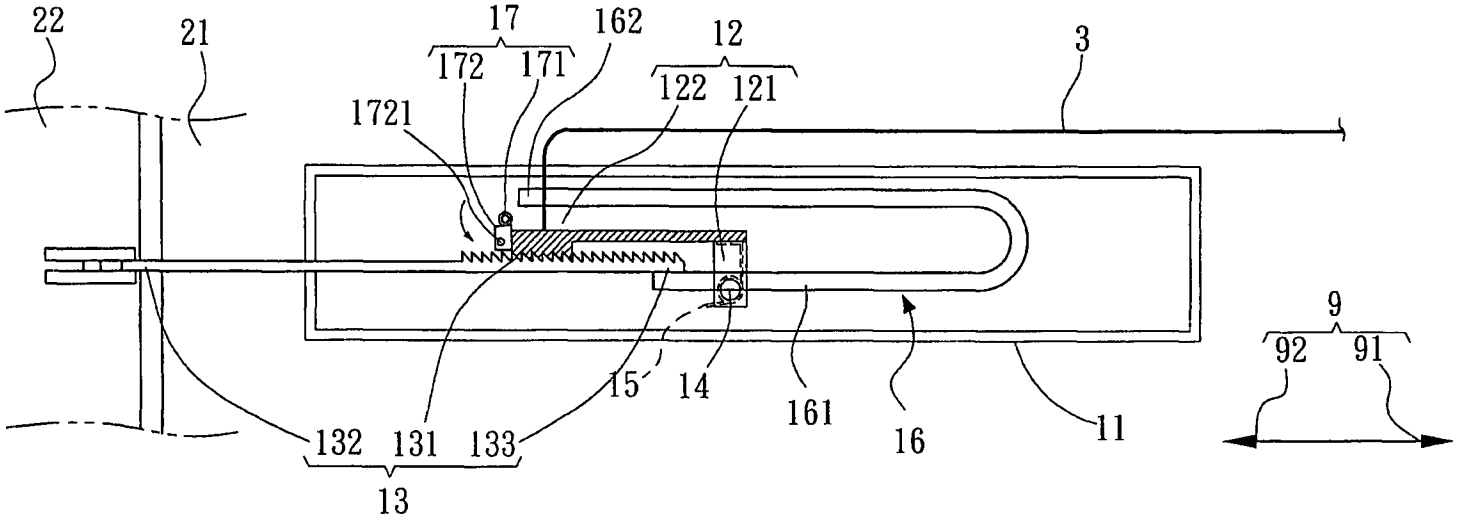
Figure 4E:
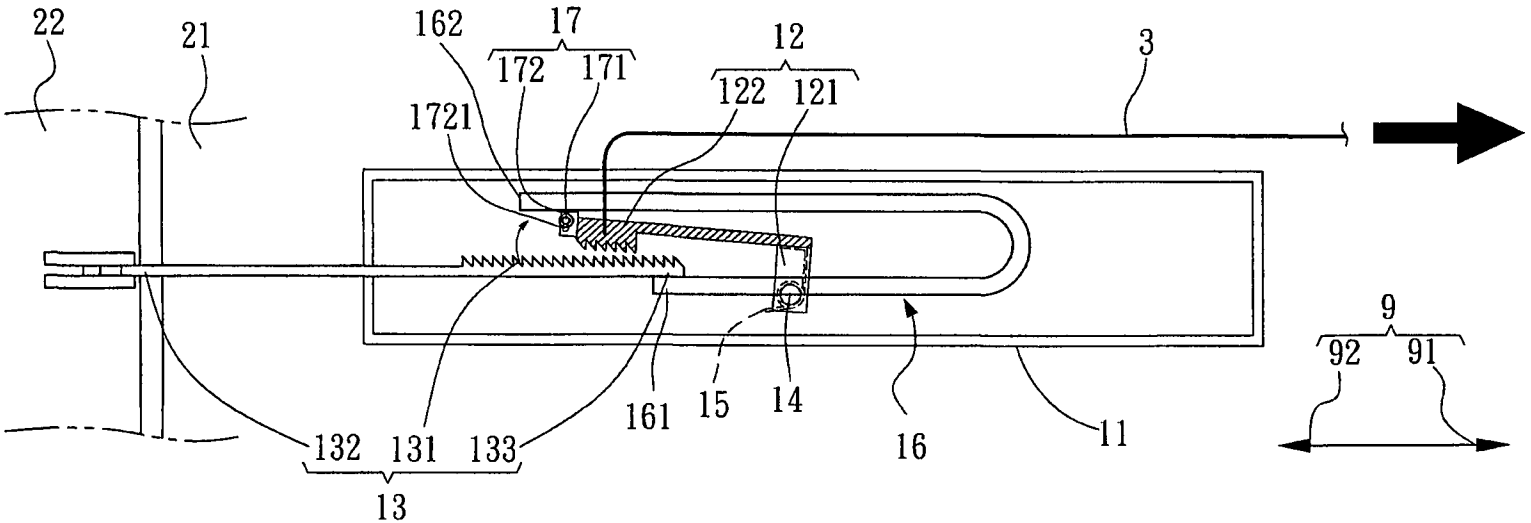
Figure 5B:
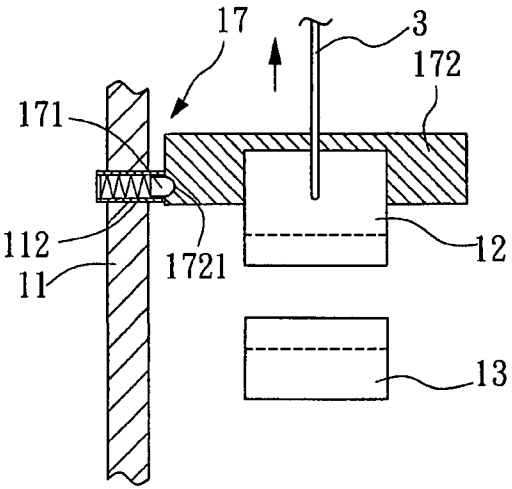
FIG. 5A~FIG. 5E illustrate continuously and schematically movement of the positioning pair of the safety braking device in accordance with the present invention by corresponding individually to FIG. 4A~FIG. 4E, respectively.
Figure 6A:
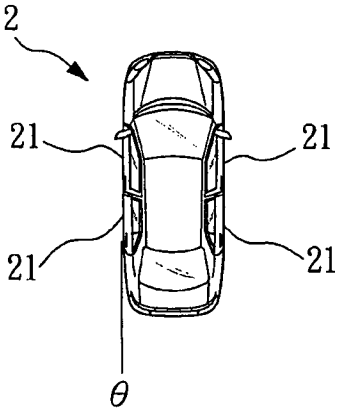
FIG. 6A~FIG. 6D illustrate individual stages of the vehicle under the opening of the door board by the handler exteriorly mounted at the door board of the safety braking device in accordance with the present invention.
Figure 5A:
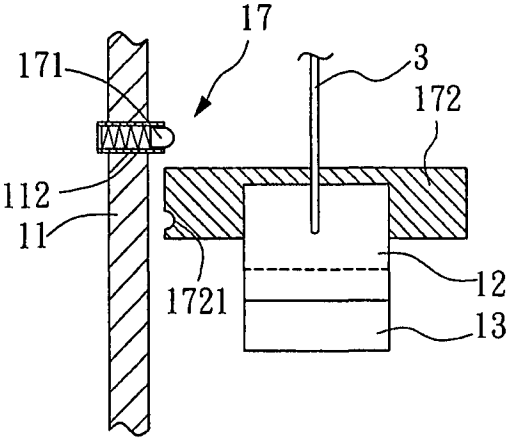
Figure 5D:
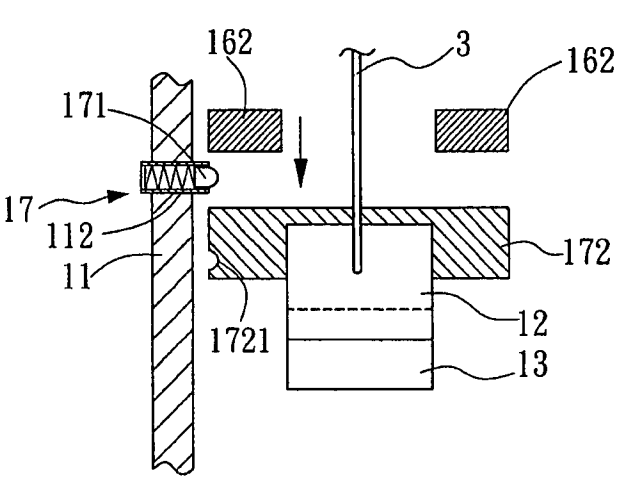
Figure 6C:
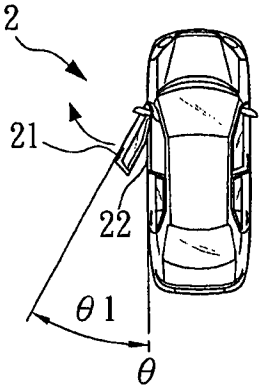
Figure 5C:
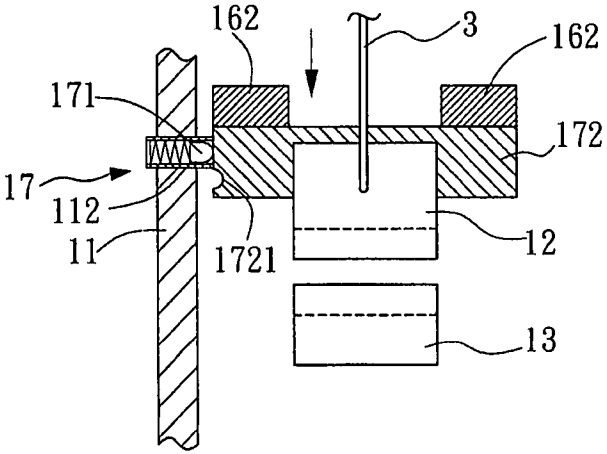
Figure 6B:
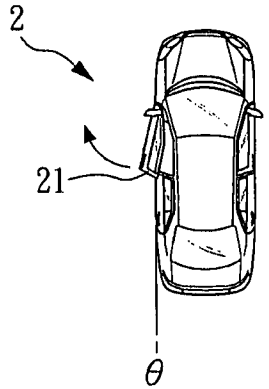
Figure 6D:
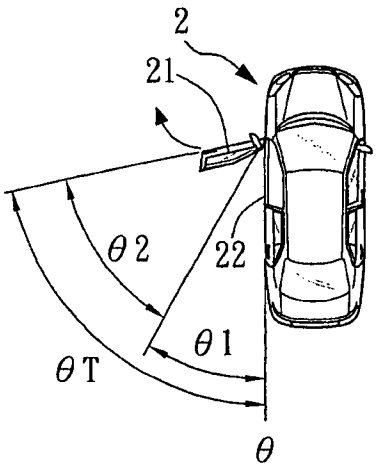

Refer now to FIG. 4A to FIG. 4E, FIG. 5A to FIG. 5E, and also FIG. 6D to FIG. 6D, in which the safety braking device for doors 1 in FIGS. 4A-4E is operated continuously upon the opening of the door board 21 by operating the handler 2111 exteriorly mounted at the door board 21. The door-open operation is performed by having the handler 2111 to pull the first cable 3 and thus the door board 21 can be turned away from the permanent seat 22.

FIG. 4A is the step one, at which the safety braking device 1 is at an initial state; i.e. the state shown in FIG. 6A where the door board 21 is still closed at the vehicle body 2 (with an open angle θ to be 0). At this state, the positioning pair 17 is posed at the state shown in FIG. 5A, in which the corresponding positioning block 172 is still separate from the elastic positioning member 171 located at the seat body 11. Hence, the one-way ratchet-tooth cam 12 and the one-way ratchet-tooth rack 13 are at an engagement state. Namely, the door board 21 is at a position close at the permanent seat 22.

FIG. 4B is the step two following the step one of FIG. 4A. In the case that a person intends to open the vehicle door from outsides, he/she needs to pull the handler 2111 so as to initiate the door opening operation. Firstly, the pulling at the handler 2111 of the door board 21 would pull the first cable 3 as well, and would further have the first cable 3 to pull the ratchet-tooth portion 122 of the one-way ratchet-tooth cam 12 to disengage the teeth portion 131 of the one-way ratchet-tooth rack 13. At this stage, the door board 21 of the vehicle body 2 shown in FIG. 6A is still close with the open angle to be 0, and the positioning pair 17 is posed at the state shown in FIG. 5B, in which the corresponding positioning block 172 is driven to displace by of the one-way ratchet-tooth cam 12 so as to reach a position that the anchoring cavity 1721 preset on the corresponding positioning block 172 is nesting one end of the elastic positioning member 171. Thereby, the door board 21 can be freely opened from the permanent seat 22. Even upon the pulling at the handler 211 is relieved, the opening of the door board 21 can proceed.

FIG. 4C is the step three following the step two of FIG. 4B. For the ratchet-tooth portion 12 has disengaged the teeth portion 131 at this stage, the operation of opening the door board 21 to a first angle θ1 of FIG. 6B can be performed, from a zero angle. While in opening the door board 21, the corresponding positioning block 17 interfered with the elastic positioning member 171 inside the safety braking device 1 can then be fed toward the position-resuming element 16. In this embodiment, the first angle θ1 of the door board 21 is preferred to be ranged between 20°~50°. Within this range of the first angle θ1, people can board the vehicle easily, and no chance of risking the safety of the pass-by persons or vehicles due to a wide-open door can be expected.

Namely, for the first end portion 132 of the one-way ratchet-tooth rack 13 is pivotally connected with the permanent seat 22, the one-way ratchet-tooth cam 12 released by the handler 2111 inside the seat body 11 can displace along the quasi-linear system 9 with respect to the door board 21, while the door board 21 is opened. Also, at the same time, the corresponding positioning block 172 located adjacent to the tip of the ratchet-tooth portion 122 can displace synchronically with the seat body 11 in the first direction 91, i.e. the direction toward the action end 162 of the position-resuming element 16.

FIG. 4D is the step four following the step three of FIG. 4C. Referring also to FIG. 6C, FIG. 5C and FIG. 5D, when the door board 21 is opened to reach the first angle θ1, the corresponding positioning block 172 inside the seat body 11 is driven by the position-resuming element 16 that is synchronically displaced with the one-way ratchet-tooth rack 13. Upon such a movement, the elastic positioning member 171 would leave and thus disengage the anchoring cavity 1721 on the corresponding positioning block 172, and thus the spring element 15 would force the one-way ratchet-tooth cam 12 to resume the engagement between the ratchet-tooth portion 122 of the one-way ratchet-tooth cam 12 and the teeth portion 131 of the one-way ratchet-tooth rack 13. At this instant, the door board 21 can reach the first angle θ1 and also can fix the position relationship between the door board 21 and the permanent seat 22. Namely, for the ratchet-tooth portion 122 of the one-way ratchet-tooth cam 12 has re-engaged the teeth portion 131 of the one-way ratchet-tooth rack 13 at this movement, therefore the door board 21 would be locked to the open direction (but able to be moved in the close-door direction) by the re-engagement between the ratchet-tooth portion 122 and the teeth portion 131. Thereby, the situation of unexpected foreign forcing to accidentally wide-open the door board can be completely avoided. However, if the handler 2111 is activated again at this instant, the door board can be still opened to a larger angle.

FIG. 4E is the step five following the step four of FIG. 4D, in which the door-opened angle is the first angle θ1. As shown in FIG. 6D, in the case that the door board 21 is intended to be wider opened, it needs to go back to pull the handler 2111 again so as to keep pulling the first cable 3 further. Thereupon, the door board 21 can then be opened to an additional second angle θ2 topping the existing first angle θ1 with respect to the permanent seat 22. At this time, a preferred total open angle θT for the door board 21 is defined as θT=θ1+θ2, in which the first angle θ1 is ranged from 20° to 50° and the total open angle θT is ranged from 20° to 90°.

Figure 5E:
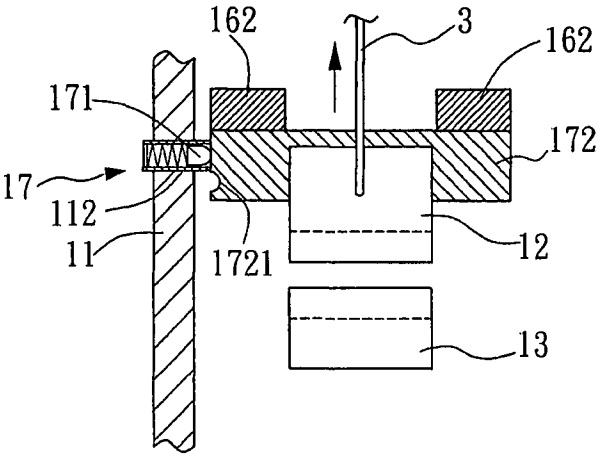

That is to say that when the handler 2111 is operated to keep pulling the first cable 3 so as to further lift the one-way ratchet-tooth cam 12, and thereby the ratchet-tooth portion 122 disengages the teeth portion 131 once again. As shown in FIG. 5E, the corresponding positioning block 172 is restrained by the action end 162 of the position-resuming element 16 so as to have the anchoring cavity 1721 on the corresponding positioning block 172 can be free from the occupation of the elastic positioning member 171. Accordingly, the door board 21 can be opened from the first angle θ1 to a wider angle of θ1+θ2. While the pulling upon the handler 2111 is relieved, the spring element 15 is introduced to have the one-way ratchet-tooth cam 12 to re-engage the one-way ratchet-tooth rack 13; such that the door board 21 can be arbitrarily and fixedly opened to any angle between θ1 and θ1+θ2, with respect to the permanent seat 22.

Refer now to FIGS. 7A~7D, FIGS. 8A~8D and FIGS. 9A~9C. As shown in FIGS. 7A~7D, the safety braking device for doors 1 in accordance with the present invention performs the typical door-open operation from the interior of the vehicle. Such an operation is mainly executed through activating the braking member 2121 on the interior side 212 of the door board 21 to pull a second cable 4 so as to open the vehicle door from the permanent seat 22.

Figure 7A:
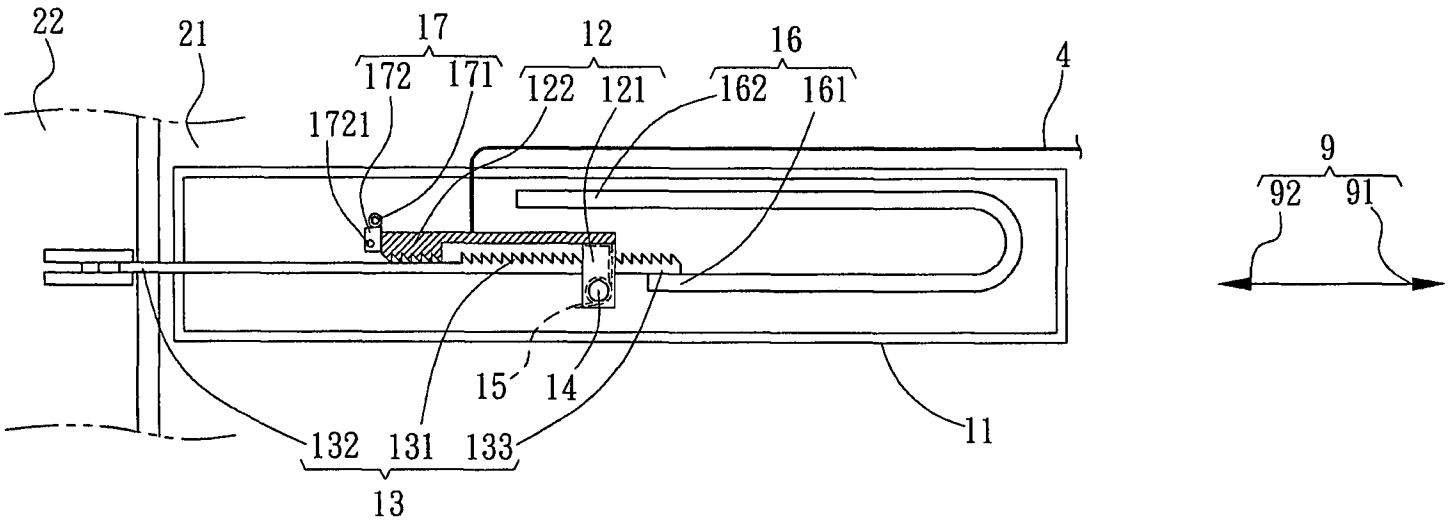
FIG. 7A~FIG. 7D illustrate continuously and schematically the opening of the door board by the braking member interiorly mounted at the door board of the safety braking device in accordance with the present invention.
Figure 8B:
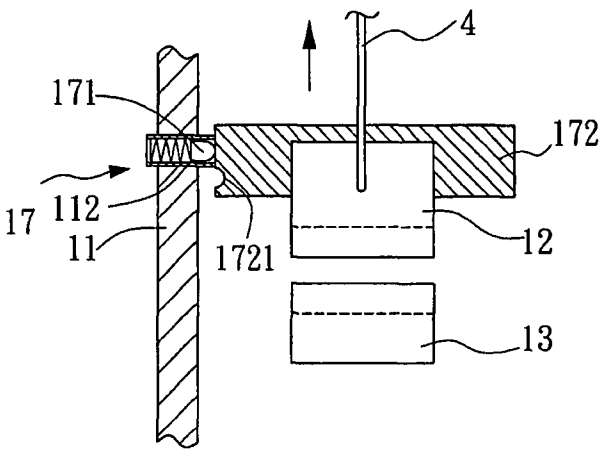
FIG. 8A~FIG. 8D illustrate continuously and schematically movement of the positioning pair of the safety braking device in accordance with the present invention by corresponding individually to FIG. 7A~FIG. 7D, respectively.
Figure 9A:
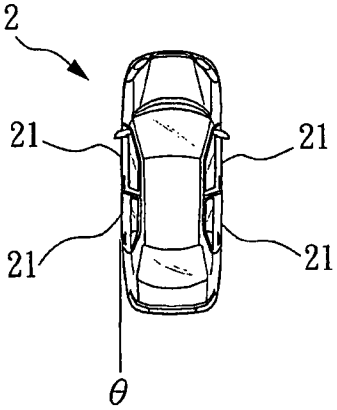
FIG. 9A~FIG. 9C illustrate individual stages of the vehicle under the opening of the door board by the braking member interiorly mounted at the door board of the safety braking device in accordance with the present invention.
Figure 8A:
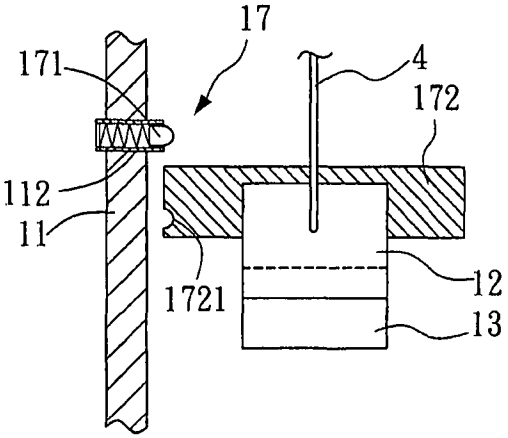

FIG. 7A illustrates the step I, where the safety braking device 1 is at an initial stage to open the vehicle door. Such a stage is also shown in FIG. 9A where the door board 21 is still close on the vehicle body 2. Also, the state of the positioning pair 17 in this initial stage is shown in FIG. 8A, where the one-way ratchet-tooth cam 12 is engaged with the one-way ratchet-tooth rack 13. Namely, in this stage, the door board 21 is close on the permanent seat 22 with a zero open-door angle θ.

Figure 7B:
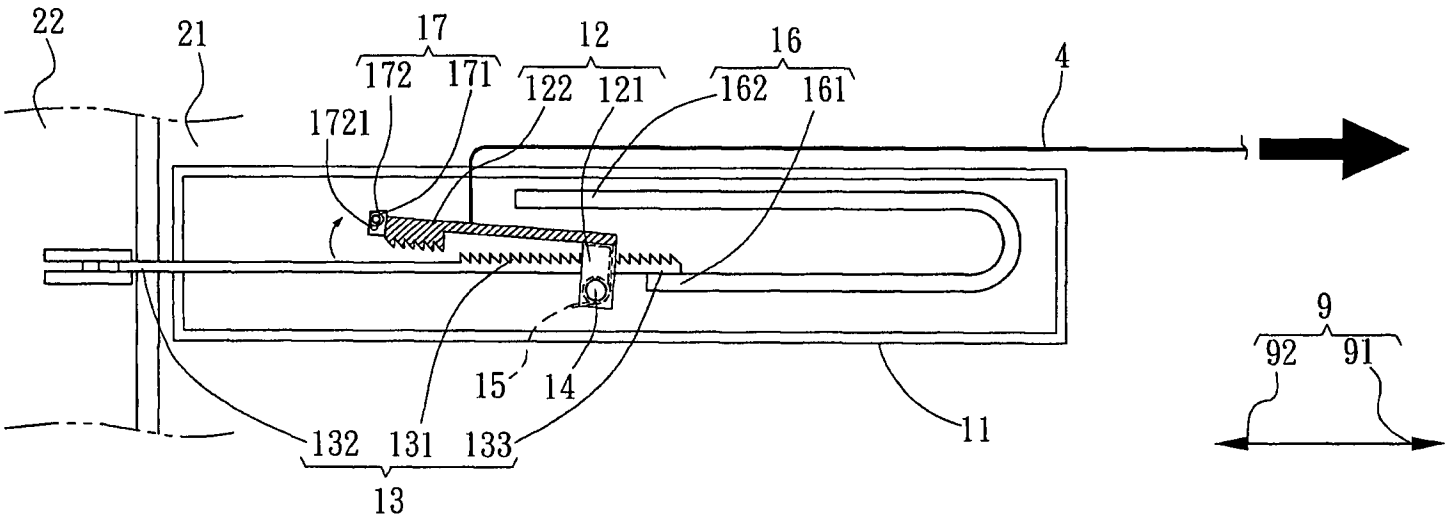

FIG. 7B illustrates the step II following the step I of FIG. 7A. For the activation stroke of the second cable 4 pulled by the braking member 2121 to perform door opening is shorter than that of the first cable 3 pulled by the handler 2111, as shown in FIG. 8B. Hence, even that the braking member 2121 is depressed to its extremity, the elastic positioning member 171 would never anchor to the anchoring cavity 1721 of the corresponding positioning block 172. Therefore, while in depressing the braking member 2121, the one-way ratchet-tooth cam 12 is just slightly lifted to disengage the one-way ratchet-tooth rack 13. As soon as the braking member 2121 is released, the one-way ratchet-tooth cam 12 would promptly resume its state of engaging the one-way ratchet-tooth rack 13. Namely, the positioning feature contributed by anchoring the elastic positioning member 171 into the anchoring cavity 1721 while in operating the door-opening operation through the exterior handler 2111 does never exist in this operation of the interior braking member 2121.

Figure 7C:
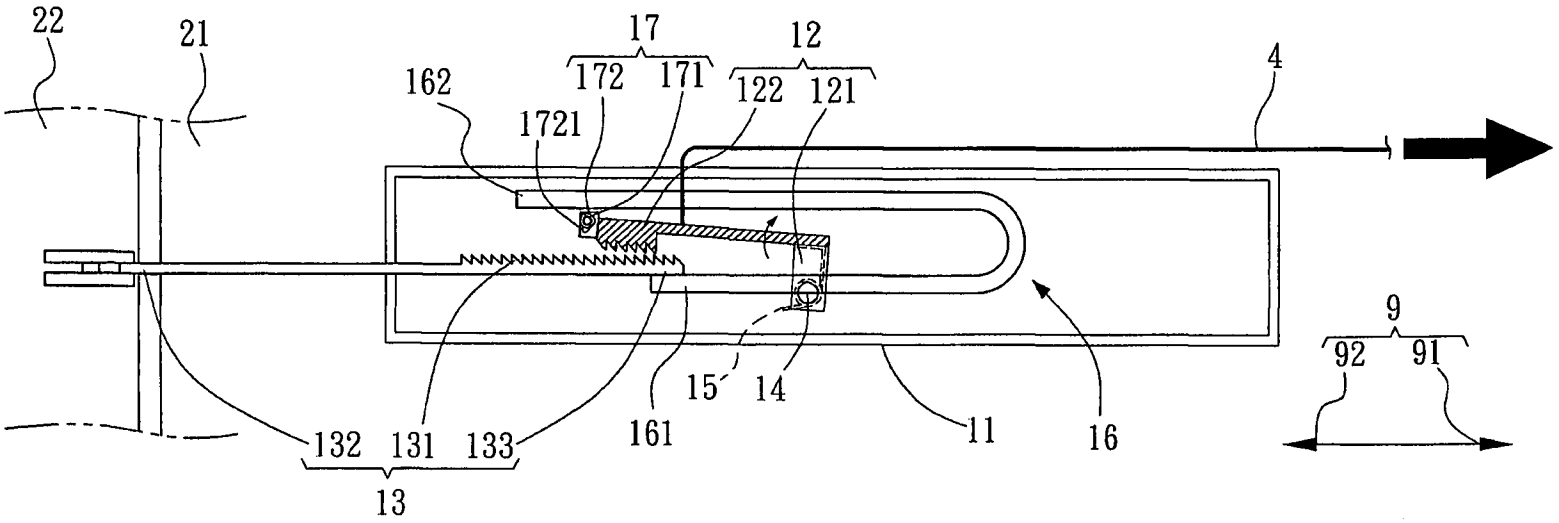
Figure 9B:
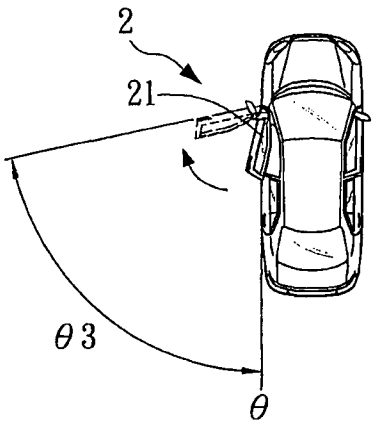
Figure 8C:
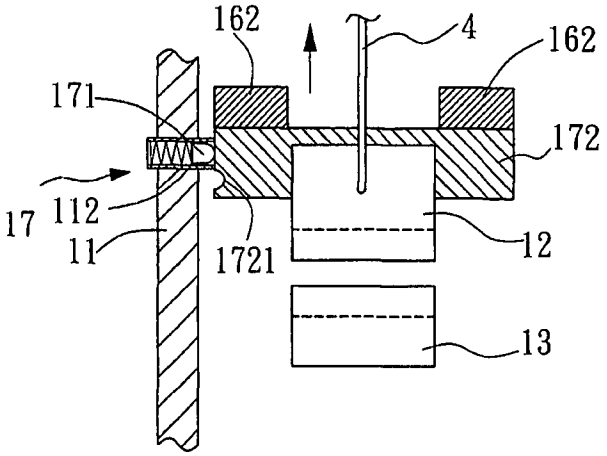

FIG. 7C illustrates the step III following the step II of FIG. 7B. Upon keeping the depression at the braking member 2121, people inside the vehicle can push the door board 21 to turn away from the permanent seat 22 by a third angle θ3, as shown in FIG. 8C and FIG. 9B. For the activation stroke of the braking member 2121 pulling the second cable 4 is shorter, the one-way ratchet-tooth cam 12 would never be affected by the action end 162 of the position-resuming element 16 that is synchronically moved with the one-way ratchet-tooth rack 13. In this door-open operation, the braking member 2121 can be depressed all the way with the pushing of the door board 21 to achieve the third angle θ3 with respect to the permanent seat 22 from the original zero close angle. In the present invention, the third angle θ3 is preferred to be ranged from 20°~90°. Namely, within the total open angle θT for the door board 21 of FIG. 6D, the action of keeping depressing the braking member 2121 can freely open the door board 21 to arbitrary angles between 20°~90°.

Figure 7D:
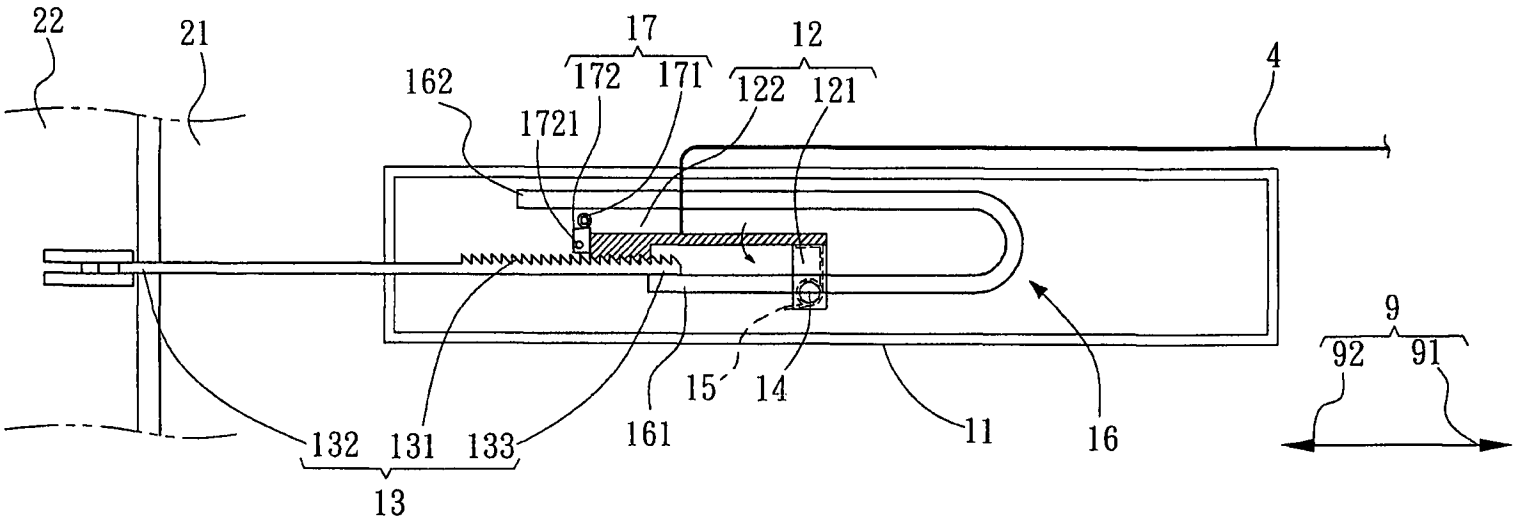
Figure 9C:
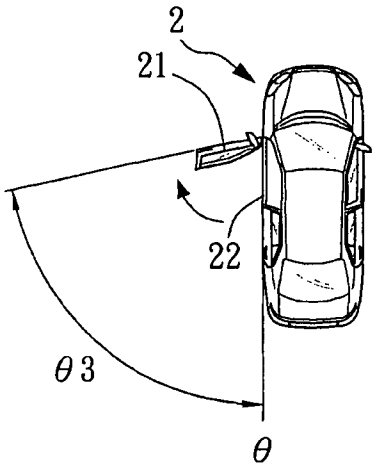
Figure 8D:
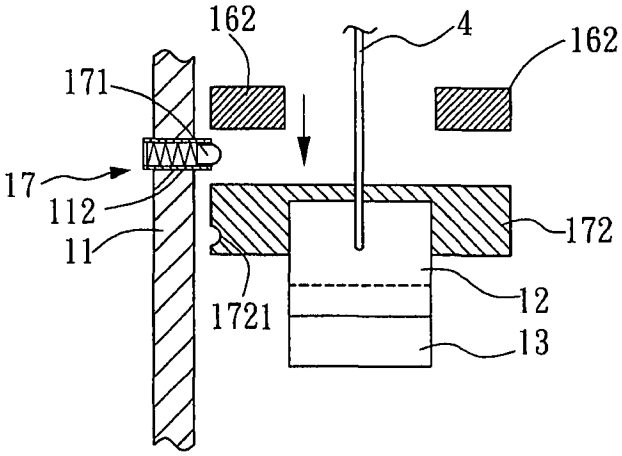

FIG. 7D illustrates the step IV following the step III of FIG. 7C. While the braking member 2121 is released as shown in FIG. 8D and FIG. 9C, the one-way ratchet-tooth cam 12 would be driven by the spring element 15 to resume its engagement (i.e. fixation) with the one-way ratchet-tooth rack 13, so that the door board 21 can be arbitrarily positioned at any angle within the third angle θ3, with respect to the permanent seat 22. Namely, by keeping depressing the braking member 2121 on the interior side 212 of the door board 21, the second cable 4 would pull the one-way ratchet-tooth cam 12 to disengage the one-way ratchet-tooth rack 13 and so as to make the door board 21 free to be rotated with respect to the permanent seat 22. While the braking member 2121 is released, the one-way ratchet-tooth cam 12 would re-engage the one-way ratchet-tooth rack 13 so as to have the door board 21 positioned at a desired angle, say the third angle θ3.

In the following description upon other embodiments of the present invention, for most of the elements thereof are resembled largely to the similar elements in the aforesaid embodiments, details about these elements would be omitted herein. For those elements, the same names and numbers as in the aforesaid embodiments would be given. However, for those elements that are not so like to the corresponding elements in the aforesaid embodiments, the same names and the same numbers but with a tailing English letter would be assigned.

Figure 10:
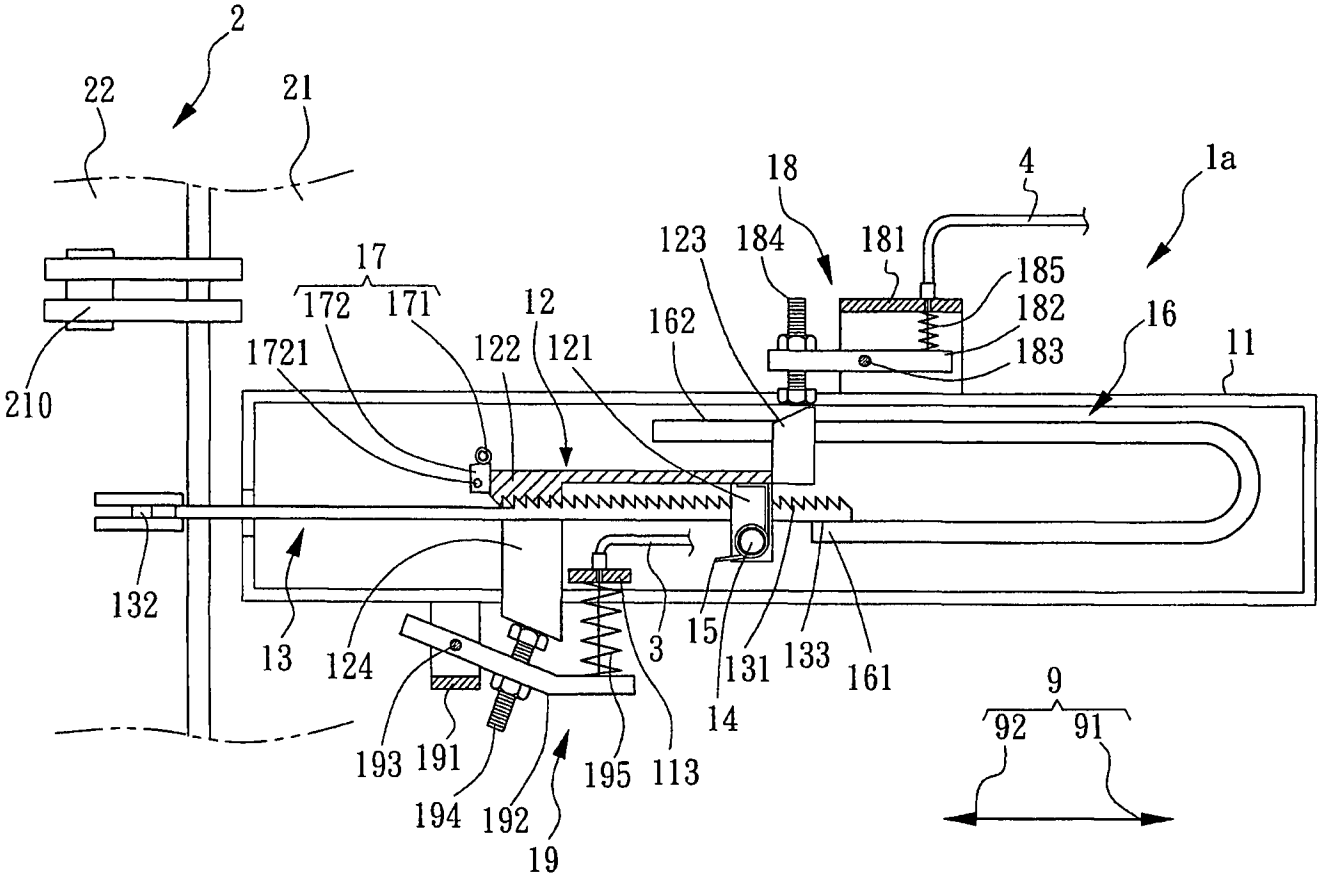
FIG. 10 is a schematic side view of a second embodiment of the safety braking device for doors in accordance with the present invention.

Referring now to FIG. 10, a second embodiment of the safety braking device for doors in accordance with the present invention is shown. In this embodiment, the major difference in between with the first embodiment of FIG. 2 is that the safety braking device 1*a* further includes a second lever mechanism 18 and a first lever mechanism 19. The second lever mechanism 18 is pivotally mounted at the seat body 11 at a position higher than the pivotal portion 121 of the one-way ratchet-tooth cam 12 and is connected with the second cable 4. The first lever mechanism 19 is pivotally mounted at the seat body 11 at a position lower than the ratchet-tooth portion 122 of the one-way ratchet-tooth cam 12 and is connected with the first cable 3.

Figure 11A:
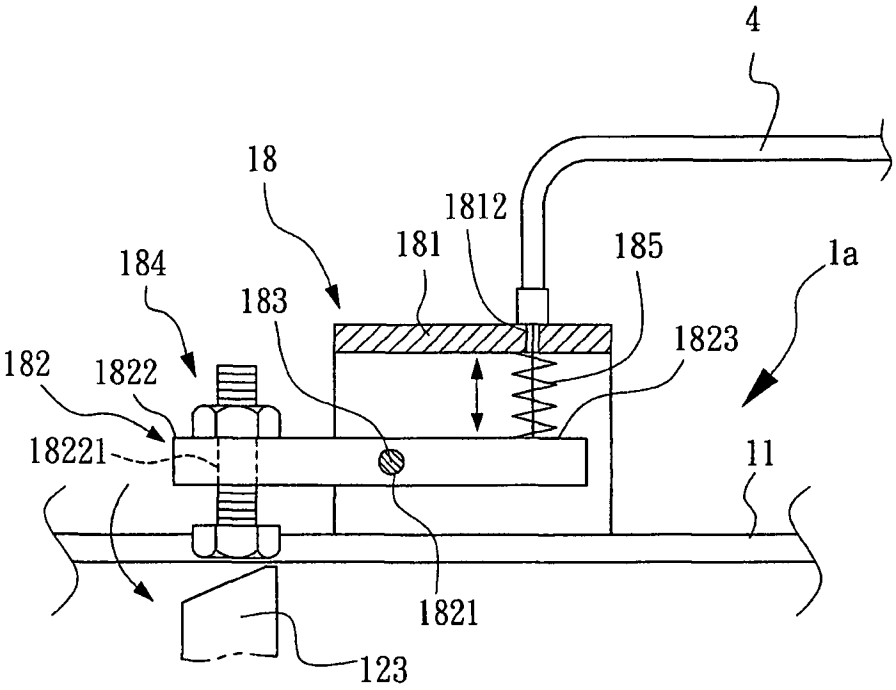
FIG. 11A is an enlarged cross-sectional view of the second lever mechanism of FIG. 10.
Figure 11B:
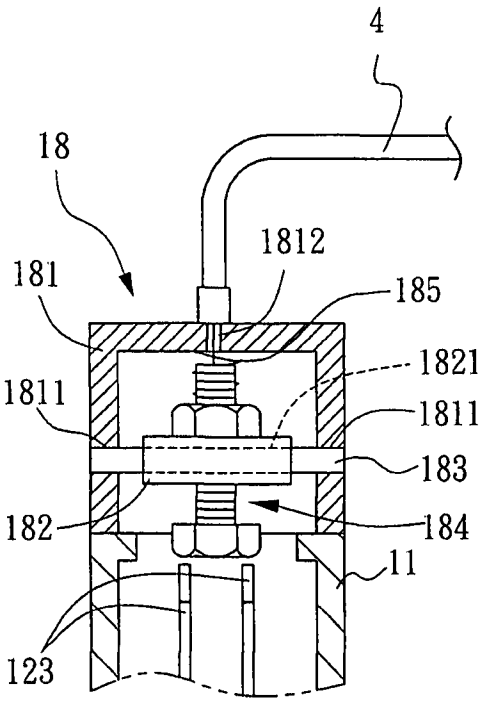
FIG. 11B is another view of FIG. 11A.
Figure 12A:
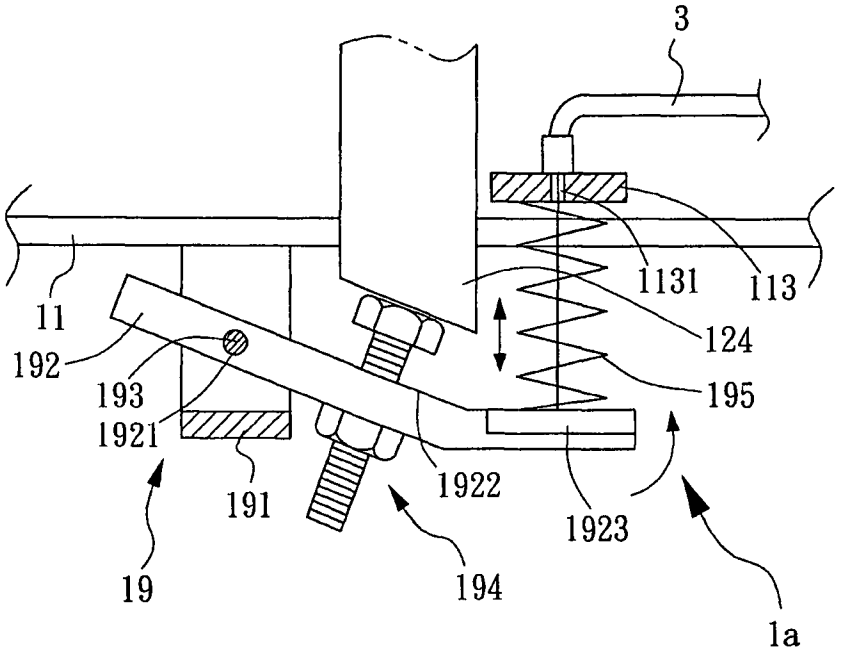
FIG. 12A is an enlarged cross-sectional view of the first lever mechanism of FIG. 10.

Refer now to FIG. 11A, FIG. 12A and also FIG. 10. the second lever mechanism 18 further includes a second frame 181, a second lever 182, a second pivotal shaft 183, a second screw set 184 and a second spring 185. Preferably, the second frame 181 is formed as a ⊓-shape frame. A second pivotal hole 1821 is largely structured at a central portion of the second lever 182, and another corresponding second pivotal hole 1811 is located at the second frame 181. The second pivotal shaft 183 is to penetrate in series the two second pivotal holes 1821, 1811 so as to pivotally mount the second lever 182 to the second frame 181. A second depression end 1822 of the second lever 182 has a second screw hole 18221 for allowing the second screw set 184 to be fixed therethrough.

In addition, a second action end 1823 of the second lever 182 is elastically mounted inside the second frame 181 with the second spring 185 to bridge the lower second action end 1823 and the upper second frame 181. One end of the second cable 4 is introduced to penetrate the second frame 181 through a second penetration hole 1812 thereof and to further connect the second action end 1823 along the extension direction of the second spring 185. Upon such an arrangement, when the braking member 2121 pulls the second cable 4, the second lever mechanism 18 is also activated by pulling up the action end 1823 of the second lever 182 and thus rocking the second lever 182 about the second pivotal shaft 183 so as to have the second depression end 1822 to move downward and thereby to depress down the second screw set 184. The down movement of the second screw set 184 would hit and then push down along a pair of second trigger blades 123 standing upright from two respective upper sides of the pivotal portion 121 of the one-way ratchet-tooth cam 12. Thereby, the one-way ratchet-tooth cam 12 is then to perform a rocker-arm motion about the pivotal shaft 14 and thus to further have the ratchet-tooth portion of the one-way ratchet-tooth cam 12 to disengage the teeth portion 131 of the one-way ratchet-tooth rack 13.

Figure 12B:
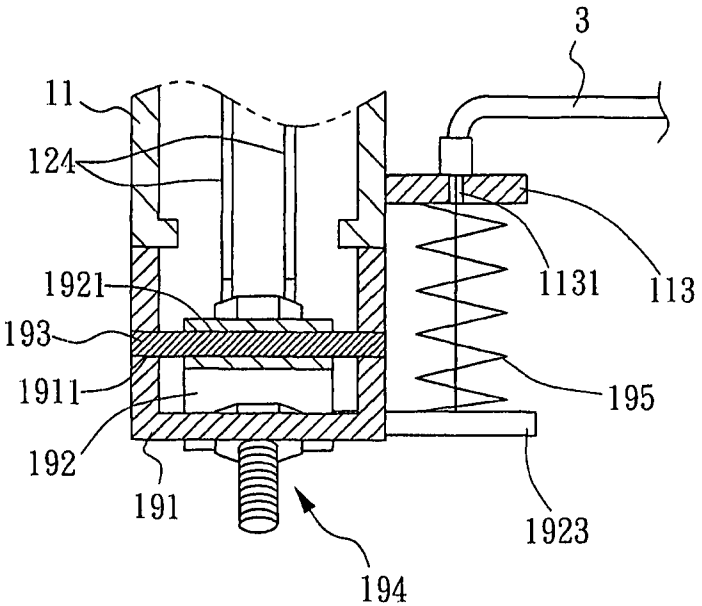
FIG. 12B is another view of FIG. 12A.

Refer now to FIG. 12A, FIG. 12B and also FIG. 10. The first lever mechanism 19 further includes a first frame 191, a first lever 192, a first pivotal shaft 193, a first screw set 194 and a first spring 195. Preferably, the first frame 191 is formed as a ⊓-shape frame. A first pivotal hole 1921 is largely structured at a central portion of the first lever 192, and another corresponding first pivotal hole 1911 is located at the first frame 191. The first pivotal shaft 193 is to penetrate in series the two second pivotal holes 1921, 1911 so as to pivotally mount the first lever 192 to the first frame 191. A first depression end 1922 of the first lever 192 has a first screw hole for allowing the first screw set 194 to be fixed therethrough.

In addition, a first action end 1923 of the first lever 192 is extended laterally and perpendicularly from the first depression end 1922 thereof. The first action end 1923 is elastically mounted to a fixation plate 113 extending perpendicular from a lateral side of the seat body 11 (to locate at the same side as the first action end 1923) with the first spring 195 to bridge the lower first action end 1923 and the upper fixation plate 113. One end of the first cable 3 is introduced to penetrate the fixation plate 113 through a first penetration hole 1131 thereof and to further connect the first action end 1923 along the extension direction of the first spring 195. Upon such an arrangement, when the handler 2111 pulls the first cable 3, the first lever mechanism 19 is also activated by having the first lever 192 to lift up the first screw set 194 and so as to hit and then push upward along a pair of first trigger blades 124 protruding downright from two respective lower sides of the ratchet-tooth portion 122 of the one-way ratchet-tooth cam 12. Thereby, the one-way ratchet-tooth cam 12 is then to perform a rocker-arm motion about the pivotal shaft 14 and thus to further have the ratchet-tooth portion 122 of the one-way ratchet-tooth cam 12 to disengage the teeth portion 131 of the one-way ratchet-tooth rack 13.

In the aforesaid description, the second screw set 184 and the first screw set 194 can both be calibrated in length before hitting the corresponding second and first trigger blades 1822, 1922 by adjusting the strokes of the individual screws and the pairing nuts 194. Such a calibration can be better achieved by further adjusting the second cable 4 and the first cable 3 with respect to the braking member 2121 and the handler 2111.

Figure 13:
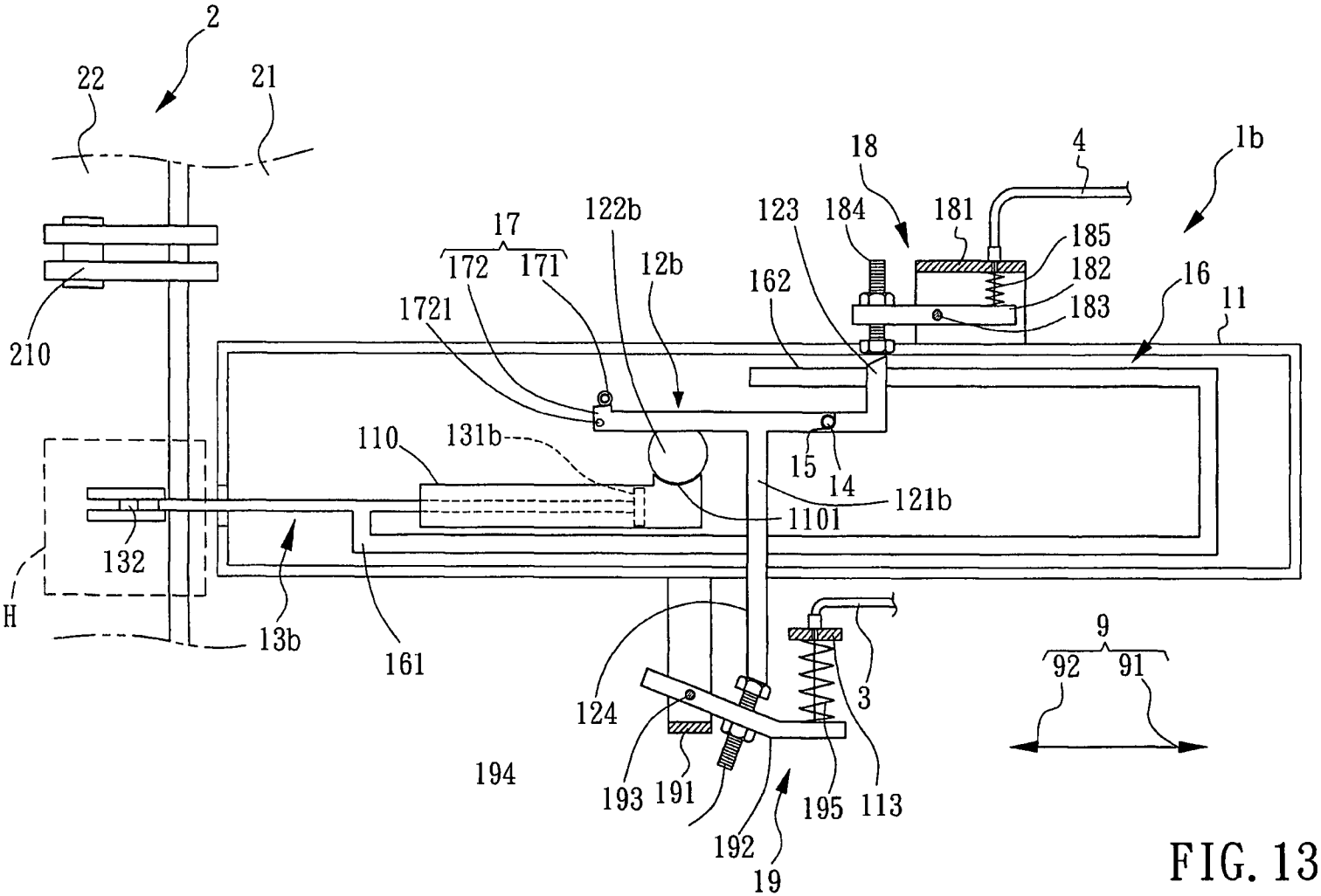
FIG. 13 is a schematic side view of a third embodiment of the safety braking device for doors in accordance with the present invention.

Referring now to FIG. 13, a schematic side view of a third embodiment of the safety braking device for doors 1*b* in accordance with the present invention is shown. In this embodiment, the one-way locking mechanism further includes a hollow cylinder 110 fixed at the seat body 11, in which the cylinder 110 has thereof an air orifice 1101 at a position corresponding to the lock position element 12*b*. In this embodiment, the lock position element 12*b* further includes a pivotal portion 121*b*, a second trigger portion 123, a first trigger portion 124 and an orifice plug 122*b*, in which the lock position element 12*b* is pivotally mounted inside the seat body 11 via a pivotal shaft 14 and the orifice plug 122*b* is located at a position corresponding to the air orifice 1101. In this embodiment, the orifice plug 122*b* can be a rubber ball or any the like able to seal the air orifice 1101 and thus to avoid possible air leakage. The connecting rod element is formed as a piston rod 13*b* further having a piston end 131*b* close to the orifice plug 122*b*. The lock position element 12*b* can be pulled by one of the two cables 3, 4 to switch between a tight position (i.e. the engagement position) and a loose position (i.e. the disengagement position). Under normal situations, the spring element 15 keeps the orifice plug 122*b* of the lock position element 12*b* to engage tightly with the air orifice 1101 of the cylinder 110. Hence, the lock position element 12*b* is at the tight position. At this time, if anyone wants to open the door board 21, the lock position element 12*b*, the seat body 11 and the cylinder 110 would displace along the first direction 91. Thereby, the air chamber inside the cylinder 110 would form an almost-vacuum environment such that the orifice plug 122*b* would be firmly and tightly sucked upon the air orifice 1101, and thus the door board 21 would be hard to be opened. On the other hand, if someone wants to close the door board 21, the lock position element 12*b*, the seat body 11 and the cylinder 110 would displace along the second direction 92. Thereby, the pressure of the air chamber inside the cylinder 110 would increase such that the orifice plug 122*b* would be pushed away from the air orifice 1101, and thus the door board 21 would be easy to be closed. Thereupon, the function of the one-way locking mechanism of the present invention is performed. In addition, when the lock position element 12*b* is pulled by one of the two cables 3, 4 so as to lift up the orifice plug 122*b* and thus open the air orifice 1101, the lock position element 12*b* is then switched to the loose position. Namely, at this time, the air orifice 1101 is opened and thus the door board 21 is easy to be either opened or closed.

In the safety braking device for doors 1*b* as shown in FIG. 13, a neutral mechanism can be included at the first end portion 132 of the piston rod 13*b* (area H of FIG. 13). The neutral mechanism is to provide the one-way locking mechanism a grace distance during an initial stage of opening the door board 21, in which the one-way locking mechanism does not function within the grace distance. Only when the door board 21 is opened to a distance over the grace distance, the piston rod 13*b* can then be driven to form vacuum inside the cylinder 110 and so as to tightly suck the orifice plug 122*b* on the air orifice 1101 and thus to thereupon formulate the one-way locking function that forbids the door board 21 to be opened.

Figure 16A:
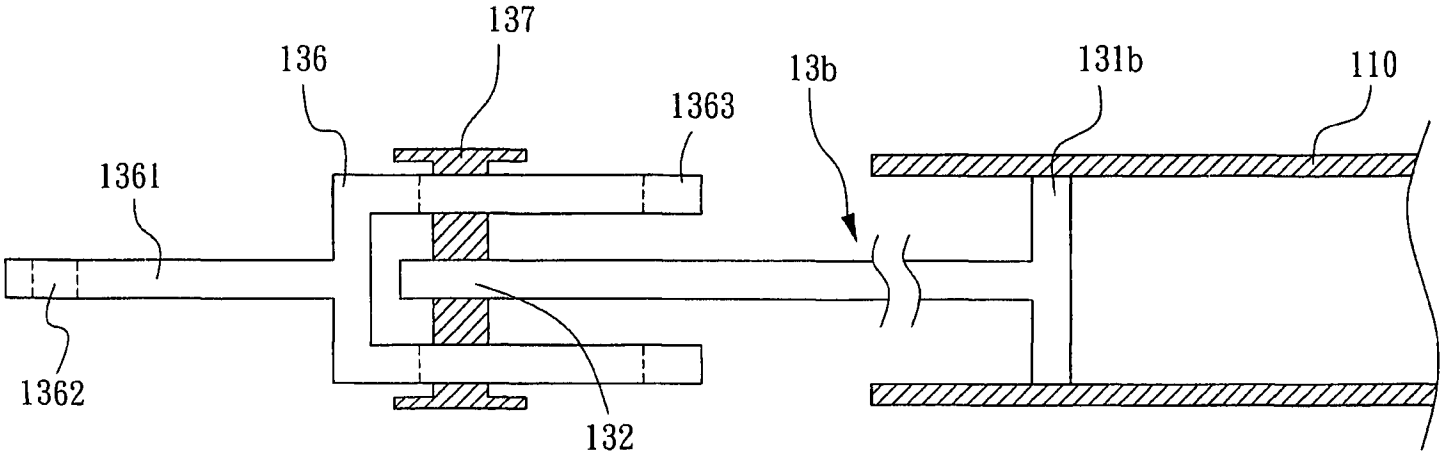
FIG. 16A and FIG. 16B are schematic side and top views of the neutral mechanism of the safety braking device for doors in accordance with the present invention.
Figure 16B:
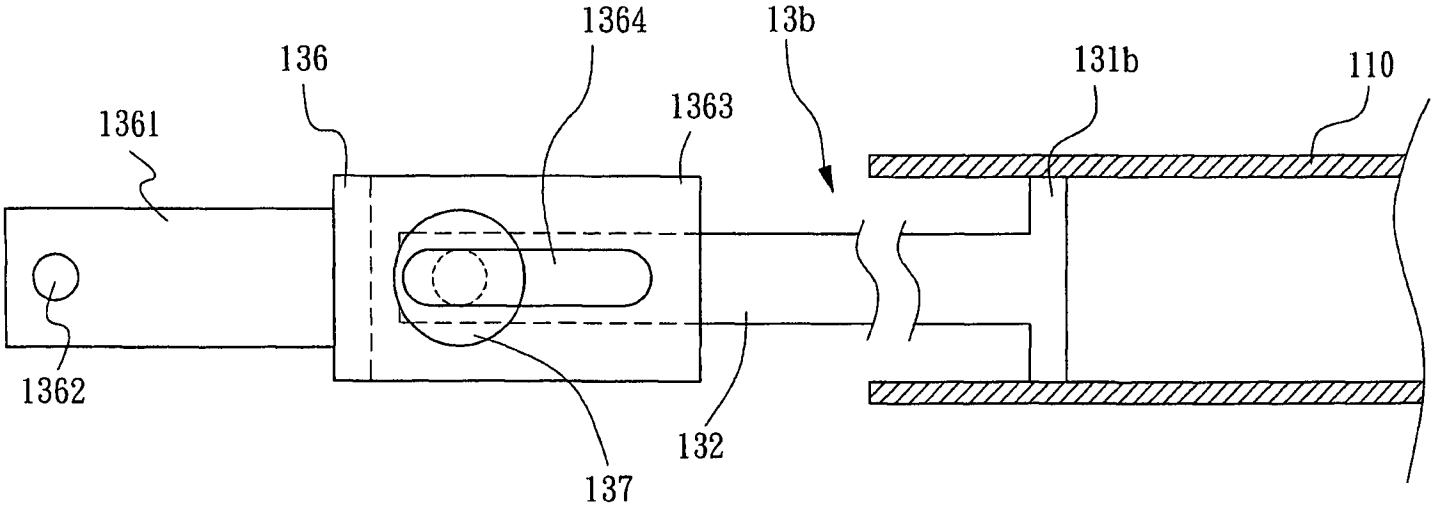

Referred now to FIG. 16A and FIG. 16B, schematic side and top views of the neutral mechanism of the safety braking device for doors in accordance with the present invention are shown, respectively. The neutral mechanism of FIG. 16A or FIG. 16B is installed to area H of FIG. 13, in which the neutral mechanism includes a fixation frame 136 and a connection screw 137 located at the first end portion 132 of the piston rod 13*b*. The fixation frame 136 as a unique piece has a fixation plate 1361 and a C-shape connection frame 1363. A fixation hole 1362 for providing connection to the permanent seat 22 is located at the fixation plate 1361. Also, a longitudinal narrow slippery slot 1364 is located at the connection frame 1363. The connection screw 137 is to penetrate through the slippery slot 1364 and to be fixed at the first end portion 132 of the piston rod 13*b;* such that the connection screw 137 a s well as the first end portion 132 can slide along the slippery slot 1364 so as to perform the linear displacement with respect to the fixation frame 136. Hence, when the one-way locking mechanism of the present invention is at the initial stage of opening the door board 21, for the connection screw 137 fixed on the first end portion 132 would slide rightward with the slippery slot 1364 from a left end position thereof, the door board 21 can be open freely without meeting the one-way locking situation while in sliding within the range of the slippery slot 1364. Only after the opening of the door board 21 leads the connection screw 137 to hit a right end position of the slippery slot 1364, any further motion in keeping opening the door board 21 would have the fixation frame 136 to drive the piston rod 13*b* and so as to form vacuum inside the cylinder 110 to suck the orifice plug 122*b* tightly on the air orifice 1101 (referred to FIG. 13). Thereupon, the function of one-way locking for stopping the door board 21 to be further opened is then generated. However, in the previous embodiment of FIG. 1 and FIG. 2 where the one-way ratchet-tooth cam 12 and the one-way ratchet-tooth rack 13 are applied, functions of the aforesaid neutral mechanism can be obtained by removing some teeth at the left hand side of the teeth portion 131 of the one-way ratchet-tooth rack 13 in FIG. 2. Thereby, when in the initial stage of opening the door board 21, the ratchet-tooth portion 122 of the one-way ratchet-tooth cam 12 would meet a temporary situation of no-teeth-to-mesh at the teeth portion 131 of the one-way ratchet-tooth rack 13. Only upon keeping opening the door board 21, the temporary situation can be removed in between, and thus the aforesaid function of the neutral mechanism can be present as well in this first embodiment.

Figure 14:
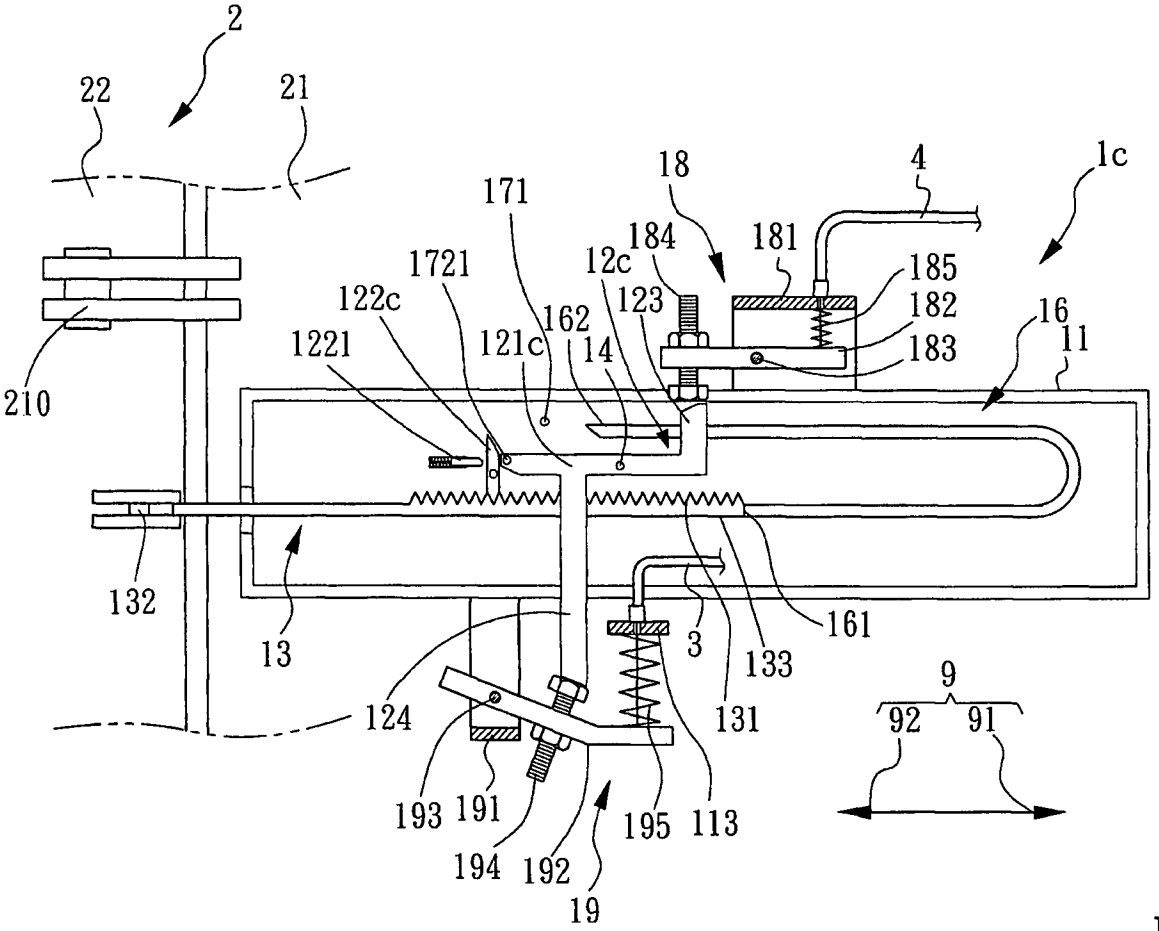
FIG. 14 is a schematic side view of a fourth embodiment of the safety braking device for doors in accordance with the present invention.

Referring now to FIG. 14, a schematic side view of a fourth embodiment of the safety braking device for doors 1*c* in accordance with the present invention is shown. In this embodiment, the one-way locking mechanism includes a lock position element 12*c* and a connection rod element. The connecting rod element is formed as a gear rack 13 and the lock position element 12*c* can further include discretely a pivotal portion 121*c*, a ratchet-tooth portion 122*c*, a first trigger portion 124 and a second trigger portion 123. The pivotal portion 121*c* can swing about a pivotal shaft 14 within a limited range. The difference between this embodiment and the embodiment of FIG. 10 is that the ratchet-tooth portion 122*c* of this embodiment in FIG. 14 is formed as a vertical longitudinal block isolated from the pivotal portion 121*c* and is pivotal mounted in a middle position to the seat body 11 so as to swing thereabout both clockwise and counterclockwise. Further, the ratchet-tooth portion 122*c* also has an upper half portion thereof to contact from a left-hand side against a position-resuming element 1221 (a compression spring for example) while the pivotal portion 121*c* (having an indent 1721) contacts against the ratchet-tooth portion 122*c* from a right-hand side of the ratchet-tooth portion 122*c* (i.e., opposite to the position-resuming element 1221). Upon such an arrangement, when the ratchet-tooth portion 122*c* is free from any foreign forcing (i.e., the normal situations), the ratchet-tooth portion 122*c* is posed at a vertical upright position to engage the gear rack 13 located thereunder. The lock position element 12*c* can be pulled by one of the two cables 3, 4 to switch between a tight position (i.e. the engagement position) and a loose position (i.e. the disengagement position).

When the two cables 3, 4 are free of forcing, the lock position element 12*c* is located at the tight position, and the upper half right portion of the ratchet-tooth portion 122*c* would contact against the pivotal portion 121*c* at the side having the indent 1721. Therefore, if anyone wants to open the door board 21, the lock position element 12*c*, the seat body 11 and the ratchet-tooth portion 122*c* would displace along the first direction 91. Then, the lower portion of the ratchet-tooth portion 122*c* would be pushed to turn clockwise by the gear rack 13, but the clockwise turning motion is forbidden for the upper right side of the ratchet-tooth portion 122*c* is restrained by contacting by the indent side of the pivotal portion 121*c*. Thereupon, the door board 21 is unable to be opened. On the other hand, if anyone wants to close the door board 21, the lock position element 12*c*, the seat body 11 and the ratchet-tooth portion 122*c* would displace along the second direction 92. Then, the lower portion of the ratchet-tooth portion 122*c* would be pushed to turn counterclockwise by the gear rack 13. However, the upper left side of the ratchet-tooth portion 122*c* would depress the position-resuming element 1221 so as to turn counterclockwise an angle till the lower portion of the ratchet-tooth portion 122*c* disengage the gear rack 13. Thereupon, the door board 21 is able to be closed. Namely, the function of the one-way locking mechanism is performed.

Further, when one of the two cables 3, 4 is pulled, the lock position element 12*c* would be driven to switch to the loose position. Namely, when any of the two cables 3, 4 is pulled, the pivotal portion 121*c* of the lock position element 12*c* would be driven by the first lever mechanism 19 or the second lever mechanism 18 to turn clockwise about the pivotal shaft 14; such that the indent side (having the indent 1721) of the pivotal portion 121*c* would be lifted and contact no more with the upper right side of the ratchet-tooth portion 122*c*. Thus, the door board 21 can be able to be either opened or closed without any influence of the one-way locking function.

Figure 15:
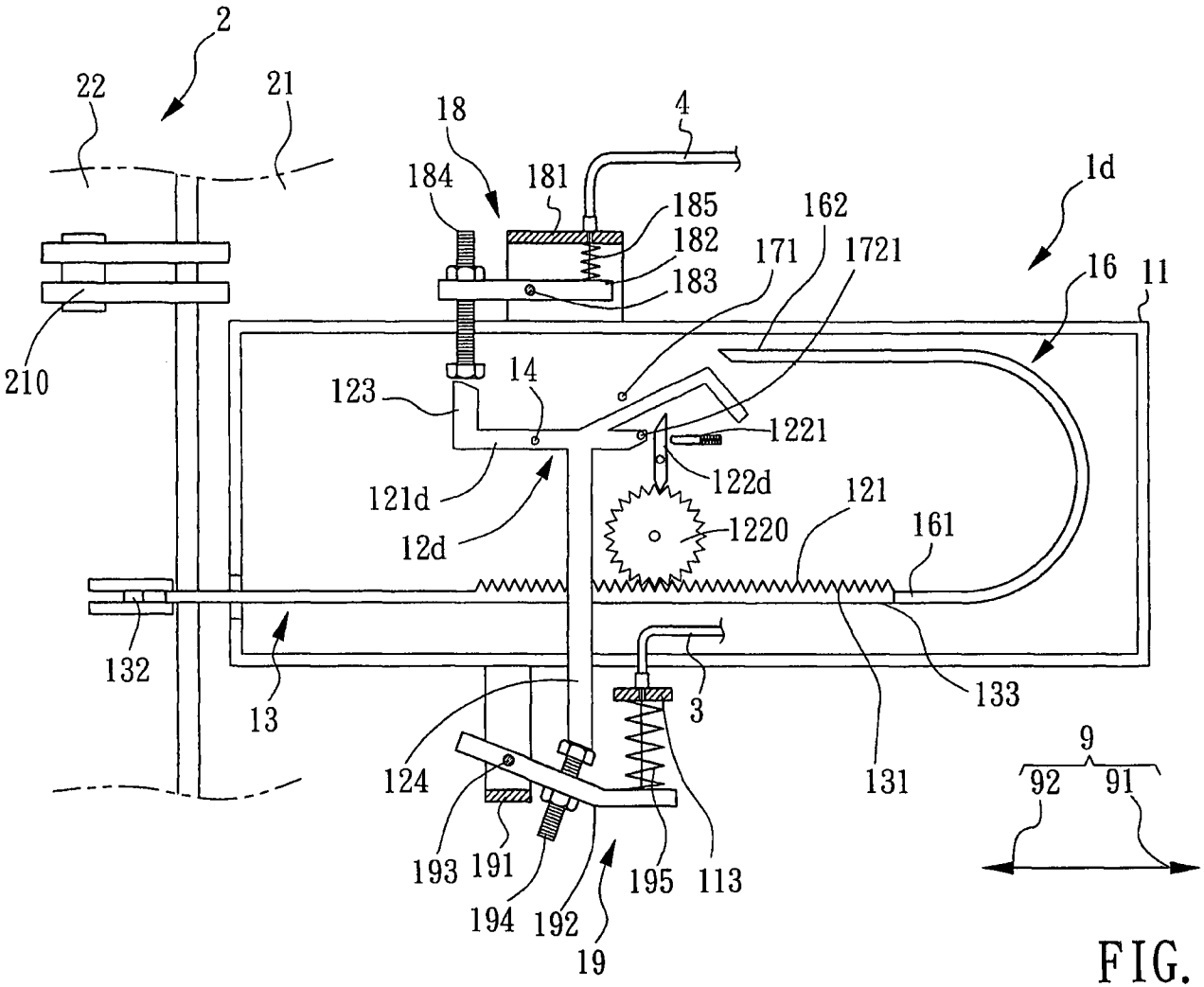
FIG. 15 is a schematic side view of a fifth embodiment of the safety braking device for doors in accordance with the present invention.

Referring now to FIG. 15, a schematic side view of a fifth embodiment of the safety braking device for doors 1*d* in accordance with the present invention is shown. In this embodiment, the one-way locking mechanism also includes a lock position element 12*d* and a connection rod element. The connecting rod element is formed as a gear rack 13 and the lock position element 12*d* can further include discretely a pivotal portion 121*d*, a ratchet-tooth portion 122*d*, a first trigger portion 124 and a second trigger portion 123. The pivotal portion 121*d* can swing about a pivotal shaft 14 within a limited range. The difference between this embodiment and the embodiment of FIG. 14 is that the embodiment of FIG. 15 further includes an idle gear 1220 located between, and also meshed in between with, the lower portion of the ratchet-tooth portion 122*d* and the gear rack 13. The ratchet-tooth portion 122*d* is pivotal mounted in a middle position to the seat body 11 so as to swing thereabout both clockwise and counterclockwise. Further, the ratchet-tooth portion 122*d* also has an upper half portion thereof to contact from a right-hand side against a position-resuming element 1221 (a compression spring for example) while the pivotal portion 121*d* (having an indent 1721) contacts against the ratchet-tooth portion 122*d* from a left-hand side of the ratchet-tooth portion 122*d* (i.e., opposite to the position-resuming element 1221). Upon such an arrangement, the lock position element 12*d* can be pulled by one of the two cables 3, 4 to switch between a tight position (i.e. able to close the door board, but unable to open the door board) and a loose position (i.e. able to open and close the door board). Other features of FIG. 15 are highly resembled to those of FIG. 14, and hence are omitted herein.

Figure 17:
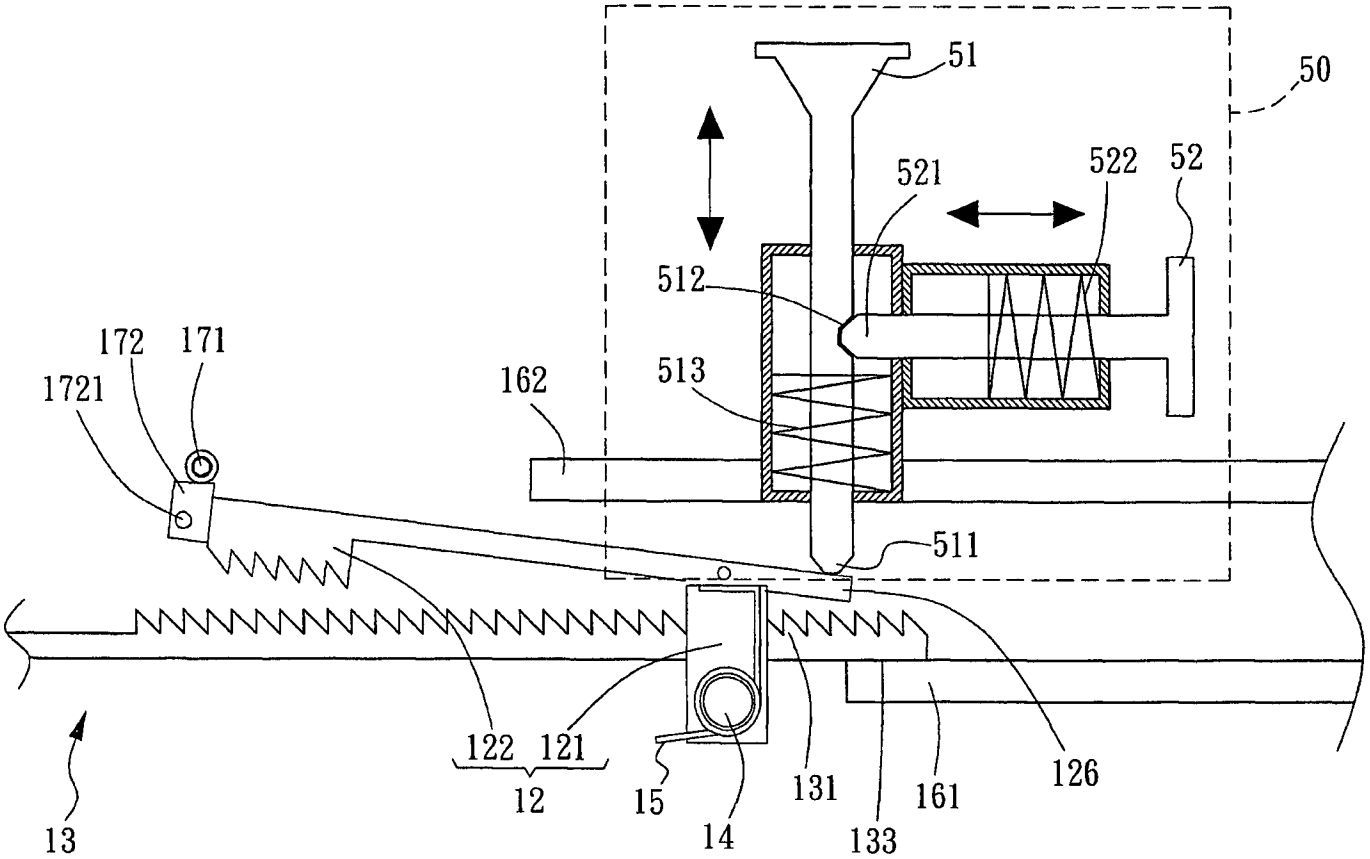
FIG. 17 is a schematic side view of the relief mechanism of the safety braking device for doors in accordance with the present invention.

In the embodiment of FIG. 2 (also referred to FIG. 17, an enlarged view of region I of FIG. 2), the safety braking device for doors 1 in accordance with the present invention can further include a relief mechanism 50 located adjacent to a tail end 126 of the lock position element 12. The relief mechanism 50 is to relieve the one-way locking function of the one-way locking mechanism so as to have the door board able to be opened to any arbitrary angle without the limitation of one-way locking. The relief mechanism 50 includes a first relief switch 51 and a second relief switch 52. A lower end 511 of the first relief switch 51 is to contact a tail portion 126 of the lock position element 12. A cavity indent 512 is located at a lateral side of the first relief switch 51. A spring 513 is installed to the first relief switch 51 in a manner of providing a preset spring potential to pull the lower end 511 of the first relief switch 51 upward away the tail portion 126 of the lock position element 12. An end 521 of the second relief switch 52 is to contact at the lateral side of the first relief switch 51. Another spring 522 is installed to the second relief switch 52 in a manner of providing a spring potential to force the end 521 of the second relief switch 52 to keep contacting the lateral side of the first relief switch 51. The relief mechanism 50 is switched between a relieved position and an unrelieved position. When the relief mechanism 50 is at the unrelieved position, the end 521 of the second relief switch 52 contacts the first relief switch 51 at a position lower than the cavity indent 512 on the lateral side. Also, due to the resilient force of the spring 513, the lower end 511 of the first relief switch 51 displaces upward so as to leave the tail portion 126 of the lock position element 12. Thereby, the ratchet-tooth portion 122 of the one-way ratchet-tooth cam 12 can displace down to engage the teeth portion 131 of the one-way ratchet-tooth rack 13 so as to provide the one-way locking function. When the relief mechanism 50 is to be switched to the relieved position so as to relieve the one-way locking function, the first relief switch 51 needs to be depressed down so as to have the lower end 511 to depress the tail portion 126 of the lock position element 12. At the same time, the cavity indent 512 is also displaced downward to the same height with the end 521 of the second relief switch 52 so as to have the end 521 to be suddenly dropped into the cavity indent 512 by the force contributed by the spring 522. Thus, the lower end 511 can be kept at a position of depressing downward the tail portion 126. For the tail portion 126 of the lock position element 12 and the ratchet-tooth portion 122 are individually kept to be located at opposing sides of the pivotal portion 121 (similar to a rocker arm mechanism). Hence, as the lower end 511 is depressed down to the tail portion 126, the ratchet-tooth portion 122 would be lifted so as not to engage the teeth portion 131. Thereupon, the door board 21 can be freely opened to any arbitrary angle without any one-way locking limitation. Namely, the one-way locking function of the one-way locking mechanism is relieved. It is noted that, when the relief mechanism 50 is shifted to the relieved position, the ratchet-tooth portion 122 needs to be lifted by a height lower than the action end 162 of the position-resuming element 16, such that the situation of the action end 162 of the position-resuming element 16 both touching the corresponding positioning block 172 in front of the ratchet-tooth portion 122 and also depressing down the ratchet-tooth portion 122 can be avoided while the door board 21 is opened to a larger angle. When the relief mechanism 50 is switched from the relieved position to the unrelieved position, the second relief switch 52 needs to be pulled so as to have the end 521 to leave the cavity indent 512, such that the lower end 511 of the first relief switch 51 would be elastically pushed by the spring 513 to displace upward and thus leave the contact with the tail portion 126. Of course, the disengagement between the end 521 and the cavity indent 512 can also be achieved by directly pulling up the first relief switch 51 so as to have the relief mechanism 50 switched from the relieved position to the unrelieved position.

Figure 18:
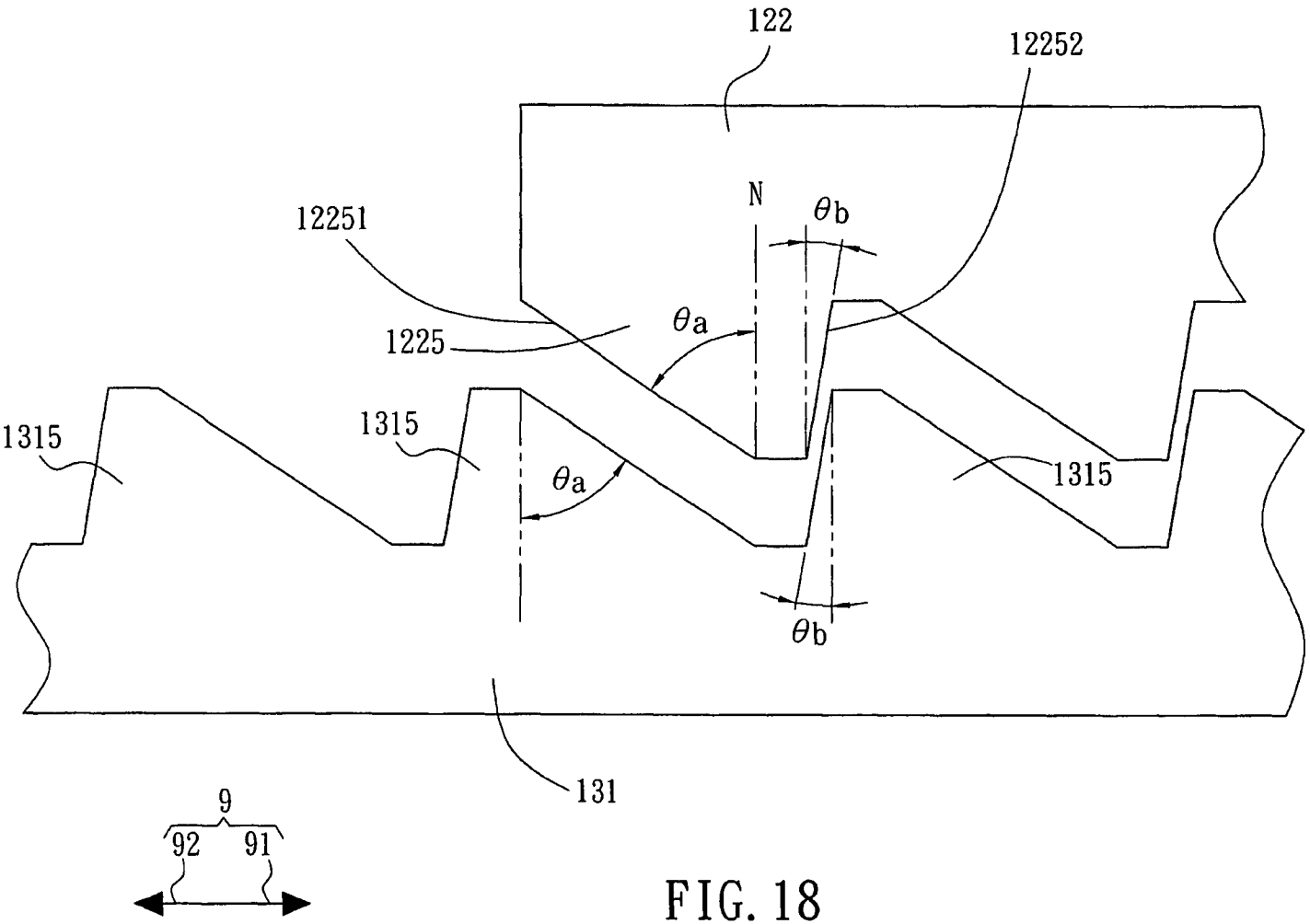
FIG. 18 is a schematic view of the emergency relief design of the safety braking device for doors in accordance with the present invention.

In the safety braking device 1 as shown in FIG. 2, an emergency relief design can be included. By providing specific tooth design to the ratchet-tooth portion 122 and the teeth portion 131, the door board 21 can be opened to a substantial large angle by emergency forcing, not by the pulling of the cables 3 and 4, while in meeting an emergency situation, in which the large angle can be an angle greater the angle θ1, and not limited to the angle greater than 60 degrees. Referred now to FIG. 18, a schematic view of the emergency relief design of the safety braking device for doors in accordance with the present invention is shown. As shown, the ratchet-tooth portion 122 of the lock position element 12 can include at least a tooth 1225, and the teeth portion 131 of the one-way ratchet-tooth rack 13 can have a plurality of teeth 1315 whose tooth profile is able to mesh with the tooth 1225 of the ratchet-tooth portion 122 of the lock position element 12. A normal line N perpendicular to the motion direction 9 is defined to the ratchet-tooth portion 122 and the teeth portion 131. In the present invention, when the one-way locking mechanism displaces in the direction of closing the door board 21 (i.e., as the ratchet-tooth portion 122 moves along the second direction 92 with respect to the teeth portion 131), the tooth 1225 of the ratchet-tooth portion 122 needs to smoothly slip away from the teeth 1315 on the teeth portion 131. Therefore, the slippery tooth face 12251 of the tooth 1225 of the ratchet-tooth portion 122 (the face facing the second direction 92 as shown in FIG. 18) needs to have a larger oblique angle θa. In this embodiment, the oblique angle θa for the slippery tooth face 12251 of the tooth 1225 of the ratchet-tooth portion 122 is preferred to be ranged between 45 degree and 87 degree with respect the normal line N. on the other hand, in order to achieve the one-way locking function during opening the door board 21, the tooth 1225 of the ratchet-tooth portion 122 has a lock-up tooth face 12252 facing the first direction 91, and the angle for the lock-up tooth face 12252 is a smaller angle θb. In this embodiment, the angle θb for the lock-up tooth face 12252 of the tooth 1225 of the ratchet-tooth portion 122 is preferred to be ranged between 5 degree and 30 degree with respect the normal line N. When the tooth 1225 of the ratchet-tooth portion 122 meshes a single tooth 1315 of the teeth portion 131 and moves along the first direction 91, due that the contact surfaces between the tooth 1225 and the tooth 1315 is the lock-up tooth face 12252 who has an angle less than 30 degree, thus a sufficient large lock-up action can be provided to prevent the door board 21 from being suddenly opened by unexpected wind power or gravity forcing (i.e., from the tooth 1225 of the ratchet-tooth portion 122 being slipped away from the tooth 1315 of the teeth portion 131). However, on the other hand, for the angle θb is larger than 5 degree, while in meeting an emergency that operating the two cables 3, 4 to relieve the one-way locking function becomes infeasible, and when people need to use human force or any tool to break the door board 21 so as to have the tooth 1225 to move along the first direction 91, the upward distributed force on the lock-up tooth face 12252 can be greater than the force that the spring element 15 can provide; such that the tooth 1225 of the ratchet-tooth portion 122 can displace upward to slip away from any contact of the teeth 1315 of the teeth portion 131. Thereupon, emergency door opening can then be achieved.

In summary, the safety braking device for doors 1 in accordance with the present invention is mainly to be equipped to a vehicle door 2. By providing the exterior side 211 and the interior side 212 of the door board 21 to install the handler 2111 and the braking member 2121, by having the first cable 3 to interface the handler 2111 and the one-way ratchet-tooth cam 12, and by having the second cable 4 to interface the braking member 2121 and the one-way ratchet-tooth cam 12, the one-way ratchet-tooth cam 12 can be pulled off the engagement with the one-way ratchet-tooth rack 13 so as to achieve the purpose of having the door board 21 to be freely opened with respect to the permanent seat 22.

However, while the door board 21 is to be opened by the exterior handler 2111, the positioning pair 17 is introduced to drive the one-way ratchet-tooth cam 12 to anchor at the preset position point 112, and thus to disengage the one-way ratchet-tooth cam 12 from the one-way ratchet-tooth rack 13. While the door board 21 is opened to the first angle θ1, the position-resuming element 16 would drive the one-way ratchet-tooth cam 12 to leave the position point 112, and the spring element 15 would force the one-way ratchet-tooth cam 12 to engage the one-way ratchet-tooth rack 13. Then, the door board 21 can be fixed with respect to the permanent seat 22. When the door board 21 is to be closed to its original position (with a zero open angle), the door board 21 can be directly pushed or pulled to close on the permanent seat 22 through the ratchet-tooth application provided by the one-way ratchet-tooth cam 12 and the one-way ratchet-tooth rack 13. Further, through having the handler to keep pulling the first cable 3, the door board 231 can be still opened to a larger angle greater than the first angle θ1, by adding an additional angle θ2, with respect to the permanent seat 22.

In addition, when the braking member 2121 mounted on the interior side 212 of the door board 21 is to open the door board 21 through the second cable 4, due that the pulling stroke of the second cable 4 at the braking member 2121 is shorter than that of the first cable 3 at the handler 2111, so simply depressing the braking member 2121 would never really fix the one-way ratchet-tooth cam 12. Namely, the anchoring cavity 1721 on the corresponding positioning block 172 would not form a fixation pair with the elastic positioning member 171. Hence, when the braking member 2121 is kept depressing, the one-way ratchet-tooth cam 12 can then disengage the one-way ratchet-tooth rack 13. While the braking member 2121 is relieved, the one-way ratchet-tooth cam 12 can resume its engagement with the one-way ratchet-tooth rack 13 via the spring element 15, and thus the purpose of closing the door board 21 to the third angle θ3 with respect to the permanent seat 22 can then be achieved.

While the present invention has been particularly shown and described with reference to a preferred embodiment, it will be understood by those skilled in the art that various changes in form and detail may be without departing from the spirit and scope of the present invention.

What is claimed is:

1. A safety braking device for doors, arranged between a door board and a permanent seat, the door board having an unlocked (opened) position and a locked (closed) position with respect the permanent seat, comprising:

a seat body, arranged in the door board; wherein, when the door board is shifting from the locked position to the unlocked position, the seat body moves along a first direction of the permanent seat; wherein, when the door board is shifting from the unlocked position to the locked position, the seat body moves along a second direction of the permanent seat;

a one-way locking mechanism, including a lock position element and a connecting rod element, the lock position element being able to displace toward and lock at the connecting rod element at the first direction, the lock position element being arranged in and co-moved with the seat body, one end of the connecting rod element being fixed onto the permanent seat while another end thereof being extended into the seat body by corresponding to the lock position element, the lock position element being switched between an engaged position and a disengaged position; wherein, when the lock position element is at the engaged position, the lock position element as well as the seat body are fixed in the first direction with respect to the connecting rod element so as not to open the door board, but the lock position element associated with the seat body is displaceable in the second direction with respect to the connecting rod element so as to close the door board; wherein, when the lock position element is at the disengaged position, the door board is eligible to be opened and to be closed;

a switching mechanism connected between the lock position element and a handler furnished on the door board; wherein, when the handler is operated, the switching mechanism switches the lock position element from the engaged position to the disengaged position;

a spring element, engaged with the lock position element so as to restrain elastically the lock position element at the engaged position while in normal situations; and a positioning pair, including an elastic positioning member and a corresponding positioning block, wherein the elastic positioning member is arranged at the seat body while the corresponding positioning block is arranged at the lock position element;

wherein a first end portion of the connecting rod element is pivotally connected to the permanent seat, an external force is introduced by operating the handler to drive and switch the lock position element to the disengaged position so as simultaneously to open the door board by an angle less than a first angle θ1, and the corresponding positioning block is fixed to the elastic positioning member so as to sustain the lock position element at the disengaged position;

wherein, when the door board is pushed away from the permanent seat to an angle larger than the first angle θ1, a position-resuming element connecting with the second end portion of the connecting rod element pushes and displaces the corresponding positioning block of the positioning pair away to separate the elastic positioning member, and the spring element resumes elastically the lock position element to the engaged position; that is, the door board is able to be locked to the permanent seat one-directionally after the door board is released from an angle larger than the first angle θ1.

2. The safety braking device for doors according to claim 1, wherein the lock position element is a one-way ratchet-tooth cam including a pivotal portion and an extending ratchet-tooth portion, the pivotal portion being pivotally connected internally with the seat body by a pivotal shaft;

wherein the connecting rod element is a one-way ratchet-tooth rack including a teeth portion, the first end portion and the second end portion, the teeth portion being meshed with the ratchet-tooth portion of the one-way ratchet-tooth cam;

wherein the spring element is furnished to ensure a normal meshing state between the one-directional ratchet-tooth cam and the one-directional ratchet-tooth rack and to activate functions of the one-way locking mechanism upon the lock position element being driven to disengage with the one-way ratchet-tooth rack.

3. The safety braking device for doors according to claim 2, wherein said switching mechanism comprises a first cable, the handler connecting a fixed end of the first cable while an opposing connection end of the first cable is connected with the one-way ratchet-tooth cam so as to pull the one-way ratchet-tooth cam to rotate about the pivotal shaft when the handler is operated; wherein, when an additional angle (specifically, a second angle θ2) over the first angle θ1 is required for the door board, the handler needs to be operated continuously so as to have the first cable to pull the one-way ratchet-tooth cam to disengage the one-way ratchet-tooth rack; wherein a total open angle θT for the door board is defined as θT=θ1+θ2, in which the first angle θl is ranged from 20° to 50° and the total open angle θT is ranged from 20° to 90°.

4. The safety braking device for doors according to claim 2, wherein said switching mechanism comprises a second cable and a braking member; wherein the braking member is arranged inside the door board and connected with (and thus driven by) a fixed end of the second cable while an opposing connection end of the second cable is connected to the one-way ratchet-tooth cam so as to pull and thus turn the one-way ratchet-tooth cam around the pivotal shaft; wherein, when the door board needs to be opened from the permanent seat, the braking member needs to be operated continuously so as to have the second cable to pull the one-way ratchet-tooth cam to disengage the one-way ratchet-tooth rack; wherein, upon the braking member is released, the spring element sends the one-way ratchet-tooth cam elastically back to engage the one-way ratchet-tooth rack so as to have the lock position element to elastically resume the engaged position.

5. The safety braking device for doors according to claim 1, wherein the one-way locking mechanism further includes a hollow cylinder fixed at the seat body, the cylinder having thereof an air orifice at a position corresponding to the lock position element; wherein the lock position element further includes a pivotal portion and an orifice plug, the pivotal portion being pivotally mounted inside the seat body via another pivotal shaft, the orifice plug being at a position corresponding to the air orifice; wherein the connecting rod element is a piston rod further having a piston end close to the orifice plug; wherein the engaged position of the lock position element is a tight position between the air orifice and the orifice plug, and the disengaged position thereof is a loose position between the air orifice and the orifice plug; wherein, under normal situations, the spring element keeps the orifice plug of the lock position element to engage tightly thereupon with the air orifice of the cylinder; wherein, under predetermined forcing upon the lock position element, the orifice plug is disengaged from the air orifice as to perform functions of the one-way locking mechanism.

6. The safety braking device for doors according to claim 1, wherein the connecting rod element is a gear rack and the lock position element further includes discretely a pivotal portion and a ratchet-tooth portion; wherein the ratchet-tooth portion formed as a vertical longitudinal block is pivotal mounted in a middle position to the seat body so as to swing thereabout both clockwise and counterclockwise and has an upper half portion thereof to contact from a left-hand side against a position-resuming element while the pivotal portion contacts against the ratchet-tooth portion from a right-hand side of the ratchet-tooth portion (i.e., opposite to the position-resuming element), such that, upon the ratchet-tooth portion being free from any foreign forcing (i.e., the normal situations), the ratchet-tooth portion is posed at a vertical upright position to engage the gear rack located thereunder;

wherein, when the lock position element is at the normal situations (i.e., free from any foreign forcing), the lock position element is kept at the engaged position where the right-hand side of the upper half portion of the ratchet-tooth portion is locked by geometrical interference with the pivotal portion so as to lock as well the door board;

wherein, when the door board is to be closed, a lower portion of the ratchet-tooth portion is pushed by the gear rack and thereby to co-move the upper half portion of the ratchet-tooth portion to depress and thus shrink the position-resuming element so as to have the lower portion of the ratchet-tooth portion to disengage the gear rack, and thereupon the door board is freely to be closed by performing the aforesaid functions of the one-way locking mechanism;

wherein, when the lock position element is switched to the loose position by foreign forcing, one end of the pivotal portion is lifted to leave the upper half portion of the ratchet-tooth portion so as to temporarily relieve the functions of the one-way locking mechanism and to make the door board ready to be opened or closed.

7. The safety braking device for doors according to claim 6, further including an idle gear located and meshed between the lower portion of the ratchet-tooth portion and the gear rack.

8. The safety braking device for doors according to claim 1, further including at least one of a electromagnetic braking mechanism; a neutral mechanism, a relief mechanism and an emergency relief design;

wherein the electromagnetic mechanism further has at least one electromagnetic valve and at least one button switch, the at least one button switch being depressed to activate the at least one electromagnetic valve so as to have the lock position element to switch between the engaged position and the disengaged position;

wherein the neutral mechanism is to provide the one-way locking mechanism a grace distance during an initial stage of opening the door board, in which the one-way locking mechanism does not function within the grace distance;

wherein the relief mechanism is to relieve one-way locking function of the one-way locking mechanism so as to have the door board to rotate freely to any angle without facing any position-locking situation;

wherein the emergency relief design is to enable the door board to be opened to a substantial large angle by emergency forcing while in meeting an emergency situation.

9. A safety braking device for doors, arranged between a door board and a permanent seat, the door board having an unlocked (opened) position and a locked (closed) position with respect the permanent seat, comprising:

a seat body, arranged and fixed in the door board; wherein, when the door board is shifting from the locked position to the unlocked position with respect to the permanent seat, the seat body moves along a first direction of the permanent seat; wherein, when the door board is shifting from the unlocked position to the locked position, the seat body moves along a second direction of the permanent seat;

a one-way locking mechanism, including a lock position element and a connecting rod element, the lock position element being able to displace toward and lock at the connecting rod element at the first direction the lock position element being arranged in and co-moved with the seat body, one end of the connecting rod element being fixed onto the permanent seat while another end thereof being extended into the seat body by corresponding to the lock position element;

at least one switching mechanism, connected between the position lock position element and a handler furnished on the door board, the handler being operated to drive the switching mechanism to make the lock position element switchable between an engaged position and a disengaged position; and a positioning pair, including an elastic positioning member and a corresponding positioning block, wherein the elastic positioning member is arranged at the seat body while the corresponding positioning block is arranged at the lock position element;

wherein, when the lock position element is at the engaged position, the lock position element as well as the seat body are fixed in the first direction with respect to the connecting rod element so as not to open the door board; wherein, when the lock position element is at the disengaged position, the door board is to be opened:

wherein, when the handler is operated to switch the lock position element to the disengaged position and when the door board Is opened by an angle less than a first angle θ1, the corresponding positioning block is fixed to the elastic positioning member so as to sustain the lock position element at the disengaged position;

wherein, when the door board is pushed away from the permanent seat to an angle larger than the first angleθ1, a position-resuming element connecting with the connecting rod element pushes and displaces the corresponding positioning block of the positioning pair away to separate the elastic positioning member, and the lock position element is resumed to the engaged position.

10. The safety braking device for doors according to claim 9, wherein the lock position element is a one-way ratchet-tooth cam including a pivotal portion and an extending ratchet-tooth portion, the pivotal portion being pivotally connected Internally with the seat body by a pivotal shaft;

wherein the connecting rod element is a one-way ratchet-tooth rack, one end thereof being fixed to the permanent seat while another end thereof is extended into the seat body so as to have the one-way ratchet-tooth cam able to engage and disengage the one-way ratchet-tooth rack; wherein the one-way ratchet-tooth rack further includes a teeth portion, a first end portion and a second end portion;

wherein the at least one switching mechanism includes a first cable and a second cable;

wherein the safety braking device for doors further includes:

a spring element, able to restrain elastically the one-way ratchet-tooth cam at an engaged state with the one-way ratchet-tooth rack while under a situation of being free of foreign forcing; wherein the corresponding positioning block is arranged at the one-way ratchet-tooth cam;

wherein the handler connecting a fixed end of the first cable while an opposing connection end of the first cable is connected with the one-way ratchet-tooth cam, the handler being turned to displace the one-way ratchet-tooth cam so as to disengage the one-way ratchet-tooth cam from the one-way ratchet-tooth rack;

wherein a braking member is arranged inside the door board and connected with a fixed end of the second cable while an opposing connection end of the second cable is connected to the one-way ratchet-tooth cam so as to pull and thus turn the one-way ratchet-tooth cam around the pivotal shaft, the braking member able to be operated to drive the one-way ratchet-tooth cam to disengage the teeth portion;

wherein the first end portion of the one-way ratchet-tooth rack is pivotally connected to the permanent seat, the handler pulling the first cable to disengage the one-way ratchet-tooth cam from the one-way ratchet-tooth rack so as simultaneously to open the door board by an angle less than the first angle θ1;

wherein, when the door board is pushed away from the permanent seat to an angle larger than the first angle θ1 the position-resuming element connecting with the second end portion of the one-way ratchet-tooth rack pushes and displaces the corresponding positioning block of the positioning pair away to separate the elastic positioning member, and the spring element resumes elastically the lock position element to the engaged position. that is, the door board is able to be locked to the permanent seat one-directionally after the door board is released from an angle larger than the first angle θ1;

wherein the braking member is operated continuously so as to have the one-way ratchet-tooth cam to disengage the one-way ratchet-tooth rack and thus to keep the door board being opening with respect to the permanent seat; wherein, upon when the braking member is released, the spring-element sends the one-way ratchet-tooth cam elastically back to engage the one-way ratchet-tooth rack so as to have the lock position element to elastically resume the engaged position.

11. The safety braking device for doors according to claim 10, wherein, when an additional angle (specifically, a second angle θ2) over the first angle θ1 is required for the, door board, the handler needs to be operated continuously so as to have the first cable to pull the one-way ratchet-tooth cam to disengage the one-way ratchet-tooth rack; wherein a total open angle θT for the door board is defined as θT=θ1 +θ2, in which the first angle θ1 is ranged from 20° to 50° and the total open angle θT is ranged from 20° to 90°.

12. The safety braking device for doors according to claim 9, wherein the one-way locking mechanism further includes a hollow cylinder fixed at the seat body, the cylinder having thereof an air orifice at a position corresponding to the lock position element;

wherein the lock position element further includes a pivotal portion and an orifice plug, the pivotal portion being pivotally mounted inside the seat body via another pivotal shaft, the orifice plug being at a position corresponding to the air orifice;

wherein the connecting rod element is a piston rod further having a piston end close to the orifice plug;

wherein the lock position element is driven by the at least one switching mechanism so as to be switched between a tight position and a loose position;

wherein, under normal situations, the orifice plug engages tightly upon the air orifice of the cylinder so as to keep the lock position element at the engaged position;

wherein, when the lock position element is driven by the at least one switching mechanism, the orifice plug is disengaged from the air orifice (from the engaged position to the disengaged position) so as to perform functions of the one-way locking mechanism.

13. The safety braking device for doors according to claim 9, wherein the connecting rod element is a gear rack and the lock position element further includes discretely a pivotal portion and a ratchet-tooth portion; wherein the ratchet-tooth portion formed as a vertical longitudinal block is pivotal mounted in a middle position to the seat body so as to swing thereabout both clockwise and counterclockwise and has an upper half portion thereof to contact from a left-hand side against a position-resuming element while the pivotal portion contacts against the ratchet-tooth portion from a right-hand side of the ratchet-tooth portion (i.e., opposite to the position-resuming element), such that, upon the ratchet-tooth portion being free from any foreign forcing (i.e., the normal situations), the ratchet-tooth portion is posed at a vertical upright position to engage the gear rack located thereunder;

wherein, when the lock position element is at the normal situations (i.e., free from any foreign forcing), the lock position element is kept at the engaged position where the right-hand side of the upper half portion of the ratchet-tooth portion is locked by geometrical interference with the pivotal portion so as to lock as well the door board;

wherein, when the door board is to be closed, a lower portion of the ratchet-tooth portion is pushed by the gear rack and thereby to co-move the upper half portion of the ratchet-tooth portion to depress and thus shrink the position-resuming element so as to have the lower portion of the ratchet-tooth portion to disengage the gear rack, and thereupon the door board is freely to be closed by performing the aforesaid functions of the one-way locking mechanism;

wherein, when the lock position element is switched to the disengaged position by foreign forcing, one end of the pivotal portion is lifted to leave the upper half portion of the ratchet-tooth portion so as to temporarily relieve the functions of the one-way locking mechanism and to make the door board ready to be opened or closed.

14. The safety braking device for doors according to claim 13, further including an idle gear located and meshed between the lower portion of the ratchet-tooth portion and the gear rack.

15. The safety braking device for doors according to claim 9, further including at least one of an electromagnetic mechanism, a neutral mechanism, a relief mechanism and an emergency relief design;

wherein the electromagnetic mechanism further has at least one electromagnetic valve and at least one button switch, the at least one button switch being depressed to activate the at least one electromagnetic valve so as to have the lock position element to switch between the engaged position and the disengaged position;

wherein the neutral mechanism is to provide the one-way locking mechanism a grace distance during an initial stage of opening the door board, in which the one-way locking mechanism does not function within the grace distance;

wherein the relief mechanism is to relieve one-way locking function of the one-way locking mechanism so as to have the door board to rotate freely to any angle without facing any position-locking situation;

wherein the emergency relief design is to enable the door board to be opened to a substantial large angle by emergency forcing while in meeting an emergency situation.

* * * * *